US009992568B2

(12) United States Patent
Slotte

(10) Patent No.: US 9,992,568 B2
(45) Date of Patent: Jun. 5, 2018

(54) METHOD AND APPARATUS FOR AUDIO PLAYBACK

(71) Applicant: Nokia Corporation, Espoo (FI)

(72) Inventor: Thomas Benedict Slotte, Turku (FI)

(73) Assignee: Nokia Technologies Oy, Espoo (FI)

( * ) Notice: Subject to any disclaimer, the term of this patent is extended or adjusted under 35 U.S.C. 154(b) by 880 days.

(21) Appl. No.: 13/875,397

(22) Filed: May 2, 2013

(65) Prior Publication Data

US 2014/0328491 A1 Nov. 6, 2014

(51) Int. Cl.
*H04R 1/10* (2006.01)
*H04R 1/28* (2006.01)

(52) U.S. Cl.
CPC ..... *H04R 1/2811* (2013.01); *H04R 1/2849* (2013.01); *H04R 2499/11* (2013.01)

(58) Field of Classification Search
CPC H04R 1/2811; H04R 1/2849; H04R 2499/11; H04R 1/2853; H04R 1/2819
USPC ..... 381/334, 73.1, 351
See application file for complete search history.

(56) References Cited

U.S. PATENT DOCUMENTS

| | | | | |
|---|---|---|---|---|
| 6,542,436 | B1 | 4/2003 | Myllyla | 367/95 |
| 7,088,828 | B1 * | 8/2006 | Bradford | G10K 11/1786 379/406.02 |
| 2001/0011993 | A1 * | 8/2001 | Saarinen | G06F 1/1605 345/156 |
| 2009/0129623 | A1 * | 5/2009 | Weckstrom | H04R 1/2842 381/386 |

OTHER PUBLICATIONS

"Micromax Gravity GC700-Price, Features of the Dual Mode CDMA/GSM mobile phone", NewTechnology Co. Inc., Jan. 5, 2013, 7 pgs.

* cited by examiner

*Primary Examiner* — Vivian Chin
*Assistant Examiner* — Douglas Suthers
(74) *Attorney, Agent, or Firm* — Harrington & Smith

(57) ABSTRACT

In accordance with an example embodiment of the present invention, an apparatus is disclosed. The apparatus includes at least one earpiece, at least one hands-free speaker, and a sound reproduction system. The sound reproduction system includes the at least one earpiece and the at least one hands-free speaker. The sound reproduction system is configured to provide a downlink audio signal to the at least one earpiece and a corresponding audio signal associated with the downlink audio signal to the at least one hands-free speaker.

19 Claims, 14 Drawing Sheets

METHOD AND APPARATUS FOR AUDIO PLAYBACK

TECHNICAL FIELD

The invention relates to earpiece and integrated hands-free loudspeakers in an electronic device and, more particularly, to audio reproduction in a mobile device.

BACKGROUND

As electronic devices continue to become more sophisticated, these devices provide an increasing amount of functionality and features. As consumers demand increased functionality from electronic devices, there is a need to provide improved devices having increased capabilities while maintaining robust and reliable product configurations.

SUMMARY

Various aspects of examples of the invention are set out in the claims.

In accordance with one aspect of the invention, an apparatus is disclosed. The apparatus includes at least one earpiece, at least one hands-free speaker, and a sound reproduction system. The sound reproduction system includes the at least one earpiece and the at least one hands-free speaker. The sound reproduction system is configured to provide a downlink audio signal to the at least one earpiece and a corresponding audio signal associated with the downlink audio signal to the at least one hands-free speaker.

In accordance with another aspect of the invention, a method is disclosed. A sound reproduction system is provided. At least one earpiece is provided. At least one hands-free speaker is provided. The sound reproduction system is configured to provide a downlink audio signal to the at least one earpiece and a corresponding audio signal associated with the downlink audio signal to the at least one hands-free speaker.

In accordance with another aspect of the invention, a computer program product including a computer-readable medium bearing computer program code embodied therein for use with a computer, is disclosed. The computer program code includes code for providing a downlink audio signal to at least one earpiece. Code for providing a corresponding audio signal associated with the downlink audio signal to at least one hands-free speaker.

BRIEF DESCRIPTION OF THE DRAWINGS

For a more complete understanding of example embodiments of the present invention, reference is now made to the following descriptions taken in connection with the accompanying drawings in which.

DETAILED DESCRIPTION OF THE DRAWINGS

An example embodiment of the present invention and its potential advantages are understood by referring to FIGS. 1 through 25 of the drawings.

Figure 2:
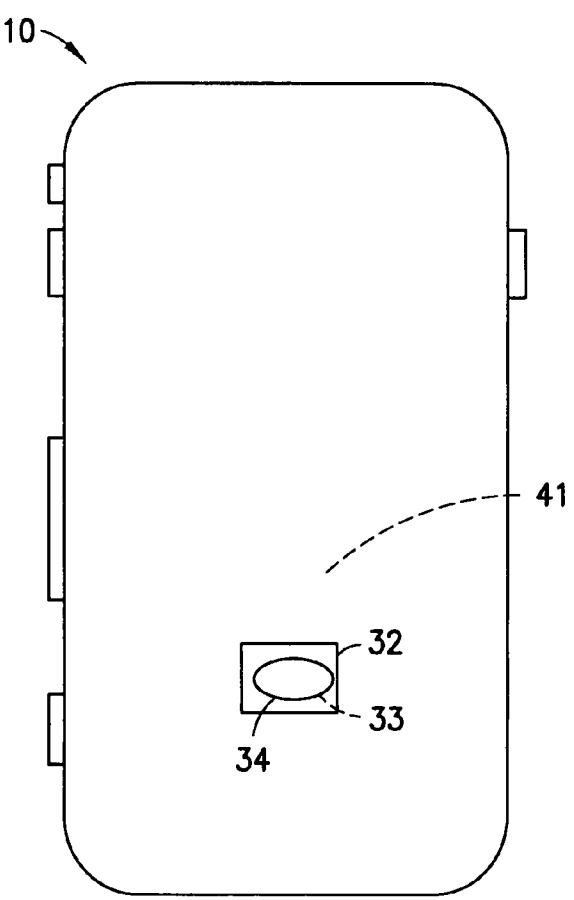
FIG. 2 is a rear view of the electronic device shown in FIG. 1.
Figure 1:
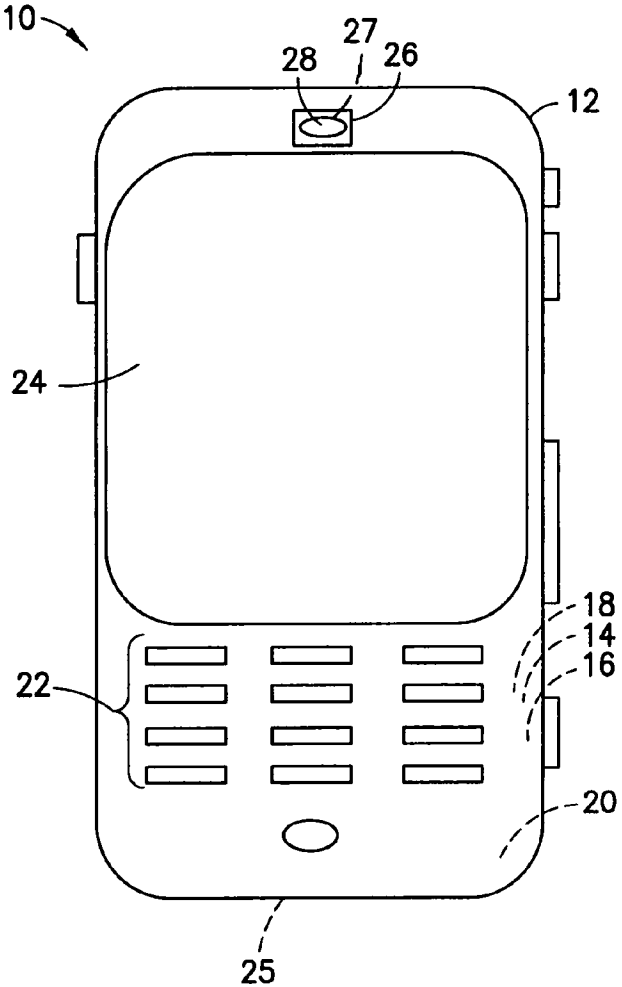
FIG. 1 is a front view of an electronic device incorporating features of the invention.

Referring to FIGS. 1 and 2, there are shown front and rear views of an electronic device 10 incorporating features of the invention. Although the invention will be described with reference to the exemplary embodiments shown in the drawings, it should be understood that the invention can be embodied in many alternate forms of embodiments. In addition, any suitable size, shape or type of elements or materials could be used.

According to one example of the invention, the device 10 is a multi-function portable electronic device. However, in alternate embodiments, features of the various embodiments of the invention could be used in any suitable type of portable electronic device such as a mobile phone, a gaming device, a music player, a notebook computer, or a personal digital assistant, for example. In addition, as is known in the art, the device 10 can include multiple features or applications such as a camera, a music player, a game player, or an Internet browser, for example. The device 10 generally comprises a housing 12, a transmitter 14, a receiver 16, an antenna 18 (connected to the transmitter 14 and the receiver 16), electronic circuitry 20, such as a controller (which could include a processor, for example) and a memory for example, within the housing 12, a user input region 22, a display 24, and a microphone 25. It should be understood that although the user input region 22 is illustrated as a keypad, various exemplary embodiments of the invention may include touch-screen technology at the user input region 22. The display 24 could also form a user input section, such as a touch screen. It should be noted that in alternate embodiments, the device 10 can have any suitable type of features as known in the art.

The device 10 further includes a sound reproduction system 41 comprising a first earpiece 26 having a sound outlet 28, and an integrated hands-free (IHF) speaker 32 having a sound outlet 34. The earpiece 26 comprises an earpiece loudspeaker 27. The loudspeaker 27 is configured to produce sound through the sound outlet 28. The integrated hands-free (IHF) 32 also comprises a loudspeaker 33. The loudspeaker 33 is configured to produce sound through the sound outlet 34. It should be noted that although the earpiece 26 and the IHF 32 are described above as having a sound outlet 28, 34, one skilled in the art will appreciate that various exemplary embodiments of the invention are not necessarily so limited and that in alternate embodiments, any suitable sound outlet configuration may be provided, such as sound outlet having a single opening, a sound outlet having two or more openings, or a sound outlet having a grid of several holes/openings, for example.

According to various exemplary embodiments, the sound reproduction system 41 can also be used as a masking system. For example, in various embodiments, provision is made for the masking system, together with the earpiece and the IHF, such that the masking system is configured to provide a masking signal to prevent privacy loss by using another loudspeaker (such as, the integrated hands-free loudspeaker, for example) to emit a simultaneous signal that masks the leaking downlink speech. Generally, the properties of this masking signal are chosen so that it severely impairs or completely prevents intelligibility of the leaking speech, while at the same time being as unobtrusive as possible. Further details regarding the masking signal will be described below. However, various other exemplary embodiments will be described first.

For example according to some exemplary embodiments an IHF speaker acting as a sub-woofer for an earpiece speaker may be provided. An optional principle in some alternative embodiments relating to the IHF acting as a sub-woofer to the earpiece is to, in contrary to the normal case, provide a tube or aperture that couples the back volume of the IHF to an earpiece sound outlet. Furthermore, close to the Helmholtz resonance the IHF speaker membrane displacement is very small and it is thus possible to add low end performance to the IHF speaker without overstressing it. It should be noted that this type of bass reflex solution, where the tube is specifically tuned to act in the manner above is provided as a non-liming example. In some other examples of the invention, the benefit of added bass from the IHF to the earpiece is available even if the tube is not tuned to act like a "bass reflex". In some embodiments the tube can also just be there without being tuned for the optimum frequency for "bass reflex".

Figure 3:
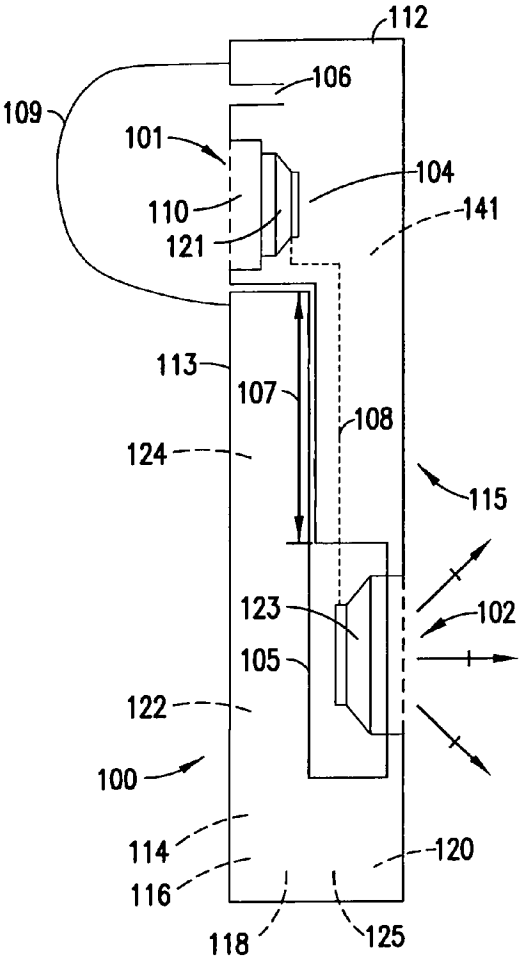
FIG. 3 is a section view of an alternate embodiment of an electronic device incorporating features of the invention.

The further embodiment of FIG. 3 depicts a device 100. Similar to the device 10, the device 100 generally comprises a housing 112, a transmitter 114, a receiver 116, an antenna 118 (connected to the transmitter 114 and the receiver 116), electronic circuitry 120, such as a controller (which could include a processor, for example) and a memory for example, within the housing 112, a user input region 122, a display 124, and a microphone 125. It should be noted that in alternate embodiments, the device 100 can have any suitable type of features as known in the art. The device 100 comprises an earpiece 101 (having a speaker or loudspeaker 121) and an IHF 102 (having a speaker or a loudspeaker 123). The IHF speaker 123 is configured to boost the earpiece speaker 121 as a subwoofer.

The further embodiment describes an example how to make the sound quality, for example wider bass response and/or sound level production of a single earpiece speaker, better by using the IHF speaker 123 as a sub-woofer for the earpiece speaker 121. According to some embodiments of the invention, the basic characteristics of the IHF 102 are generally more robust than in known normal use in order to help provide wider bandwidth requirements (however, it should be noted that a more robust IHF, or an IHF having higher performance capabilities, than a conventional IHF, is not required, and any suitable IHF may be provided). Thus the IHF speaker 123 works as a subwoofer for the earpiece 101.

Referring back to the further embodiment of FIG. 3 the mobile phone 100 comprises the earpiece 101 including the earpiece speaker 121. The earpiece speaker 121 is generally open to the space 104 inside the device. An ear 109 of the user can be positioned close to or connected to the front cavity 110 (or directly) and further to the earpiece 101. The earpiece 101 can be aimed to produce sound to the front side 113 of the phone 100. It should be noted that in various further embodiments the conception with respect to the front side of the mobile might vary. For example, it can be the same side where the keypad is located or the same side where the earpiece speaker is located. Accordingly it should not be constructed as a limiting the scope. Additionally, it should be further noted that while various exemplary embodiments of the invention have been described in connection with the earpiece speaker being just left open to the space inside the device (which is usually a large irregular cavity with many random leaks here and there through the device covers) as shown in FIG. 3, one skilled in the art will appreciate that the various exemplary embodiments are not necessarily so limited and that in some alternate embodiments the earpiece may comprise a back cavity 104' (see FIG. 4), wherein the back cavity 104' generally surrounds the periphery of the earpiece speaker 121, and generally provides for the earpiece speaker to be enclosed in a dedicated sealed cavity.

The mobile phone 100 comprises further the IHF 102 including the IHF speaker 123. A back cavity 105 surrounds the periphery of the IHF speaker 123. The IHF speaker 123 can produce louder sound than the earpiece speaker 121 so that the mobile can be operated at a distance "hands free" or even by reaching it with an arm. The IHF speaker 123 can have bigger structure than the earpiece speaker 121. In particularly because the positioning of the IHF 102 in the phone 100 is not so critical as the earpiece (more examples in the following). The IHF 102 can be directed to produce sound to the backside 115 of the phone 100, i.e. back panel. The backside of the phone may also vary depending on the definition. For example, it can be the side where the keypad, IHF speaker, earpiece speaker, etc. is located. Thereby it should not be constructed as limiting the invention.

Figure 4:
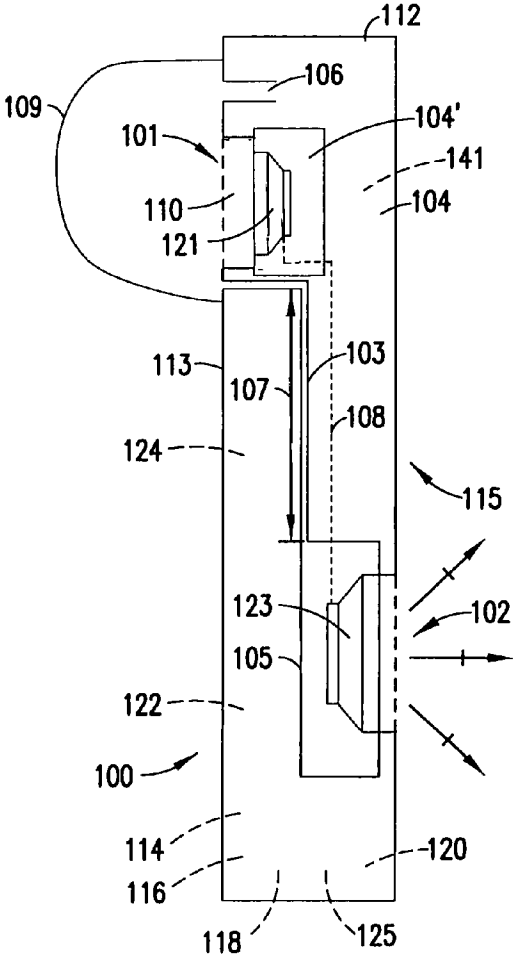
FIG. 4 is a section view of an alternate embodiment of an electronic device incorporating features of the invention.

Referring to the further embodiment of FIG. 3 (or FIG. 4), the earpiece speaker 121 and the IHF speaker 123 work together as a speaker, e.g. a two-way large speaker or the like. Generally the IHF 102 works as a subwoofer to the earpiece 101 in order to make wideband sound better, for example to increase the bass response of the earpiece 101. The earpiece 101 further comprises an elongated or a tubular cavity 103, which according to some embodiments of the invention, extends out of the back cavity 105. However, it should be noted that the back cavity and the tubular cavity may comprise any suitable type configuration. For example, according some exemplary embodiments, instead of having a substantially identifiable border between the back cavity and the tubular cavity, the back cavity may gradually and smoothly change shape towards the tubular cavity. In some other embodiments, the back cavity may extend all the way up to the device cover, proximate to the earpiece, and the tubular cavity may then just comprise a hole in the device cover. The tubular cavity 103 can be a pipe to the outside environment of the housing of the mobile phone 100 proximate the earpiece 101. However in some other embodiments, the tube, or tubular cavity may alternatively lead into the front cavity 110 of the earpiece 101. This configuration would provide an advantage in that a hole for the tube 103 is then not needed in the device cover. Advantageously, the tubular cavity 103 extends from the back cavity 105 of the IHF 102 out of the mobile phone 100 to the same side 113, where the earpiece 101 is directed to produce sound (as shown in FIG. 3 or 4). It should be noted that the tubular cavity 103 may also extend from the back cavity 105 to any suitable location.

In various further embodiments, the back cavity 105 and the tubular cavity 103 form a resonator. The IHF speaker 123 is designed to work as close as possible to the resonance frequency of the existing structural Helmholtz resonator when the excursion of the diaphragm is minimized due to the resonance. The resonator comprises the back cavity 105 of the IHF 102 and the tubular cavity 103 to the outside environment. The tuned resonance frequency of the resonator is lower compared to the resonance of the earpiece 101, but the resonator has also certain limits in the low frequencies.

Referring back to the further embodiment of FIG. 3 (or FIG. 4) the earpiece 101 and the IHF 102 can be located at a distance 107 from each other. According to various further embodiments the earpiece 101 and the IHF 102 are located relatively far away from each other. The basic characteristics of the earpiece 101 are preferred to be essentially more robust (i.e. larger) than in normal use in order to guarantee the wideband requirements, e.g. the bass response requirements by the bigger excursion of the diaphragm. At least one leak hole 106 can be alternatively used in various further embodiments to protect the user against high sound levels, e.g./typically higher than 120 dB levels. The tubular cavity 103 may be configured, by choosing its dimensions and shape in a suitable way, to act in a nonlinear fashion. This way it can provide additional protection against too high sound levels coming from the IHF. It should be noted that the term "nonlinear" generally means in this case that the tube 103 acts like a higher and higher acoustic resistance when the sound pressure increases, thus providing some additional protection. In some embodiments there may be additional acoustic damping material somewhere along tube 103 to attenuate the sound coming to the earpiece from the IHF.

In the further embodiment of FIG. 3 (or FIG. 4) the sound quality achieved by the earpiece can be better, with the better bass response. Furthermore wider and possible more flat spectrum can be obtained. The sound level can also be increased when used in noisy conditions. This can be implemented in a smaller space compared to a situation where the earpiece works alone. This is especially applicable/suitable for small devices. It should be noted that this may generally depend on the specific use case. For example, the tube 103 may require additional space when compared to a conventional solution that has no such tube, but on the other hand the earpiece loudspeaker can also be smaller when compared to a conventional solution, so the net difference in size between the configurations will depend on the specific case.

Furthermore the mobile device 100 comprises audio controlling means 108 or the like configured to control the co-operation of the earpiece speaker 101 and IHF speaker 102. For example an audio controller of the mobile phone 100 can contain the audio controlling means 108. The audio controlling means may be implemented by software or by programmable logic, e.g. circuits. The audio controlling means 108 controls the co-operation of the speakers 101 and 102 so that the IHF 102 is acting as a sub-woofer for earpiece 101. In addition the audio controlling means 108 may implement a stereo effect.

Similar to the device 10, the mobile device 100 further comprises a masking system (or sound reproduction system) 141. According to various exemplary embodiments of the invention, the sound reproduction system 141 is configured to control the audio controlling means 108. Additionally, according to various exemplary embodiments of the invention, the masking system 141 is also connected to the earpiece and the IHF such that the masking system is configured to provide a masking signal to prevent privacy loss by using another loudspeaker (such as, the integrated hands-free loudspeaker, for example) to emit a simultaneous signal that masks the leaking downlink speech (such as, from the tubular cavity 103 and/or the earpiece speaker 101, for example).

Figure 5:
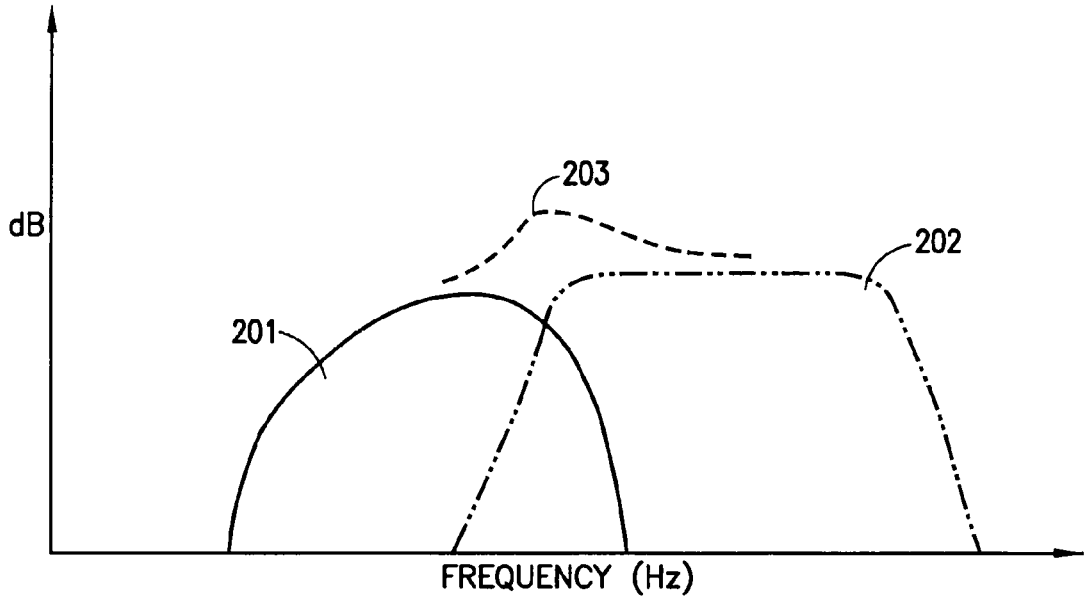
FIG. 5 is a sound level response diagram according to exemplary embodiments.

FIG. 5 depicts a sound level response of the earpiece of the further embodiment of FIG. 3 (or FIG. 4). Diagram 201 illustrates a sound level response produced by the earpiece 101. Diagram 202 illustrates a sound level response produced by the earpiece 101. Thus advantageously an increased bass response of the generated sound level can be seen from diagrams 201 and 202, where the common area yielding to increased bass response as indicated by a dotted line 203 in FIG. 5.

Some further embodiments of the invention require the earpiece speaker to be more performance oriented. This could thus be used in wireless communication devices where the display does not reach all the way to the top edge of the phone. Thereby allowing more flexible earpiece speaker design.

In various further embodiments the properties of speakers can be controlled according to the surrounding environment. Alternatively they can produce together more sound level to the noisy environment or more wide and flat spectra (lower distortion) when extra good sound quality is required. Thus the audio characteristics of the apparatus are controllable. The audio controlling means 108 can be configured to adapt the earpiece 101 and/or the IHF 102 to the surrounding environment. Furthermore the mobile phone 100 may contain input or feedback means in order to adapt the earpiece 101 and/or the IHF 102 to the surrounding environment.

According to some exemplary embodiments of the invention, the device 100 provides a hands free speaker boosting the earpiece speaker. Fashion and miniaturization is asking for smaller and smaller earpieces. At the same time the earpiece holes are pushed closer to the upper edge of the phone thus increasing the need for the earpiece to provide a high air volume displacement.

In some embodiments of the invention, the IHF speaker is generally located at the top of the phone, for example typical in a Nokia monoblock configuration. It is possible to use the output from a reflex tube, e.g. the elongated cavity, from the back volume of the IHF speaker to boost the lacking lower end of the small earpiece speaker. Because the boost is provided at frequencies below the Helmholtz resonance of the back volume no adverse effect is caused for the IHF performance.

Figure 6:
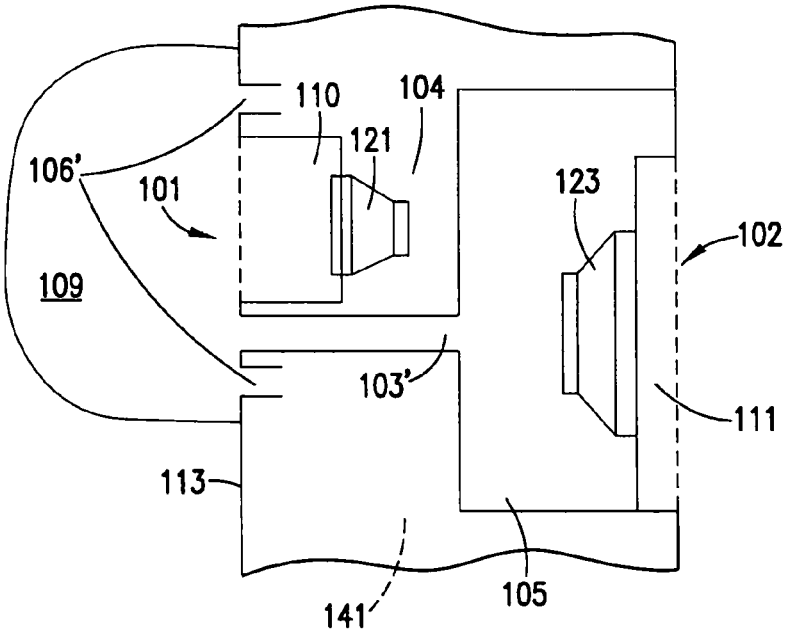
FIG. 6 is a partial section view of an alternate embodiment of an electronic device incorporating features of the invention.

Referring now to a further embodiment of FIG. 6, the earpiece 101 and the IHF 102 operates commonly as a two-way earpiece. In the further embodiment, the IHF speaker 123 gives boosting help as a subwoofer for the earpiece 101. This can, for example, improve the sound quality in the phones. Thus the earpiece 101 and the IHF 102 work together as a two-way speaker. In various further embodiments they can essentially be located relatively close to each other. However keeping in mind the sizes of the earpiece speaker 121 and IHF speaker 123, which are assumed typical ones, the needed space can be compact making various further embodiments feasible with respect to the location of the speakers within the mobile phone.

The earpiece 101 comprises an elongated or tubular cavity 103' which connects the IHF cavity 105 to the side of the housing, to which the earpiece speaker 121 is principally designed to produce sound. For example, a small cross section pipe 103' connects the IHF cavity 105 to the front panel 113 of the earpiece 101. The tubular cavity 103' and cavity 105 can work together as a low pass filter to prevent higher frequencies to be transmitted from the IHF 102. In the further embodiment illustrated in FIG. 6, the earpiece 101 and the IHF 102 are located in the opposite sides of a device. However the tubular cavity 103' connects the IHF 102 to the earpiece 101. It should be noted that according to various exemplary embodiments, the earpiece speaker 121 is generally open to the space 104 inside the device (which may be an undefined internal airspace inside the device, for example). However, in some alternate embodiments the earpiece may comprise a back cavity 104' (see FIG. 7), wherein the back cavity 104' generally surrounds the periphery of the earpiece speaker 121, and generally provides for the earpiece speaker to be enclosed in a dedicated sealed cavity.

It should be noted that in various further embodiments the conception with respect to the front side of a device may also vary. For example, it can be the same side where the keypad is located or the same side where the earpiece speaker is located. Accordingly it should not be constructed as a limiting the scope. The tubular cavity 103' may also extend from the back cavity 105 to the space, which is close to the ear of the user. The space can be closed or open air space. Furthermore the tubular cavity 103' can extend the back cavity 105 next to the earpiece speaker 121.

In various further embodiments, the leak holes 106' can be used close to the earpiece 101 to protect the user against higher than 120 dB sound levels.

Figure 7:
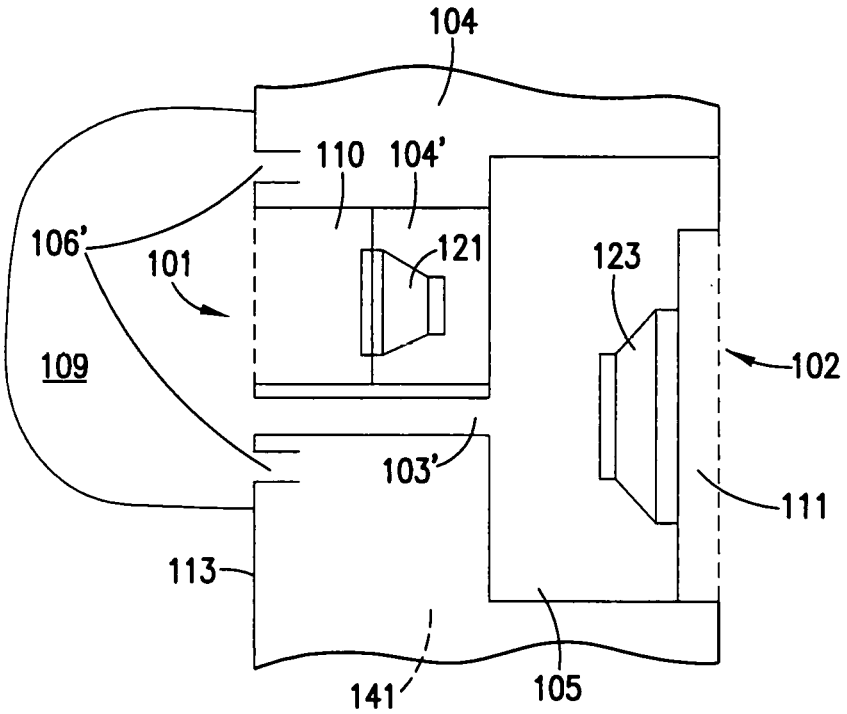
FIG. 7 is a partial section view of an alternate embodiment of an electronic device incorporating features of the invention.

The FIGS. 6 and 7 embodiments relating to the properties of speakers can be controlled according to the surrounding environment. Alternatively they can produce together more sound level to a noisy environment or more wide and flat spectra (lower distortion) when extra good sound quality is required. Thus the audio characteristics of the apparatus are controllable. The audio controlling means 108 can be configured to adapt the speaker 121 and 123 to the surrounding environment. Furthermore the device 100 may contain input or feedback means in order to adapt the speakers 121 and 123 to the surrounding environment. Furthermore the device 100 comprises audio controlling means 108 or the like configured to control the co-operation of the earpiece speaker 121 and IHF speaker 123. For example an audio controller of a mobile phone 100 can contain the audio controlling means 108. The audio controlling means may be implemented by software or by programmable logic, e.g. circuits. The audio controlling means 108 controls the co-operation of the speakers 121 and 123 so that the IHF speaker 123 is acting as a sub-woofer for earpiece speaker 121. In addition the audio controlling means 108 may implement a stereo effect.

Figure 8:
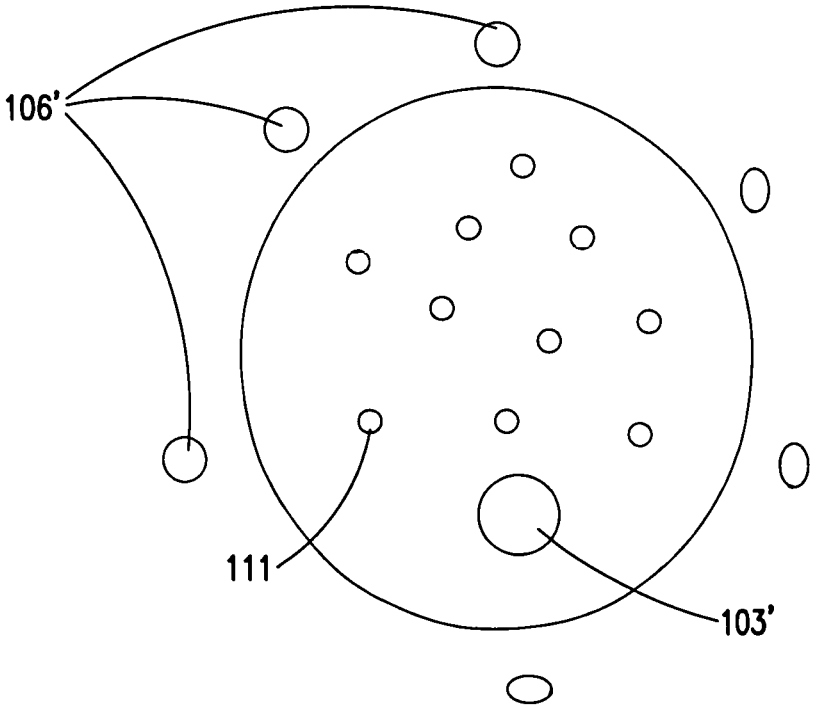
FIG. 8 is a partial enlarged view of an alternate embodiment of an electronic device incorporating features of the invention.

FIG. 8 shows a cutaway of the further embodiments relating to FIGS. 6, 7. The tubular cavity 103' is shown on the front panel of the mobile phone 100. Furthermore the leak holes 106' are dispersed around the earpiece interface. Holes 111 of the front cavity 110 are dispersed on the panel. It should be noted that although FIG. 8 illustrates the leak holes 106' as comprising several holes, in alternate embodiments, any suitable number of leak holes 106' may be provided, such as, only a single leak hole, or two or more leak holes, for example. Similarly, although FIG. 8 illustrates the holes 111 as comprising several holes, in alternate embodiments, any suitable number of holes 111 may be provided, such as, only a single hole, or two or more holes, for example. Furthermore, the open end of the tubular cavity 103' may include one or more holes, instead of only a single hole. Additionally, as described above, the tubular cavity may lead into the front cavity 110, thus providing for the tubular cavity opening(s) effectively being "hidden" and combined with the hole(s) 111.

It should further be understood that similar to the embodiments shown in FIGS. 3, 4, the further embodiments relating to FIGS. 6-8 also utilize the masking system 141 in a similar fashion. According to various exemplary embodiments of the invention, the masking system is connected to the earpiece and the IHF such that the masking system is configured to provide a masking signal to prevent privacy loss by using another loudspeaker (such as, the integrated hands-free loudspeaker, for example) to emit a simultaneous signal that masks the leaking downlink speech.

Figure 9:
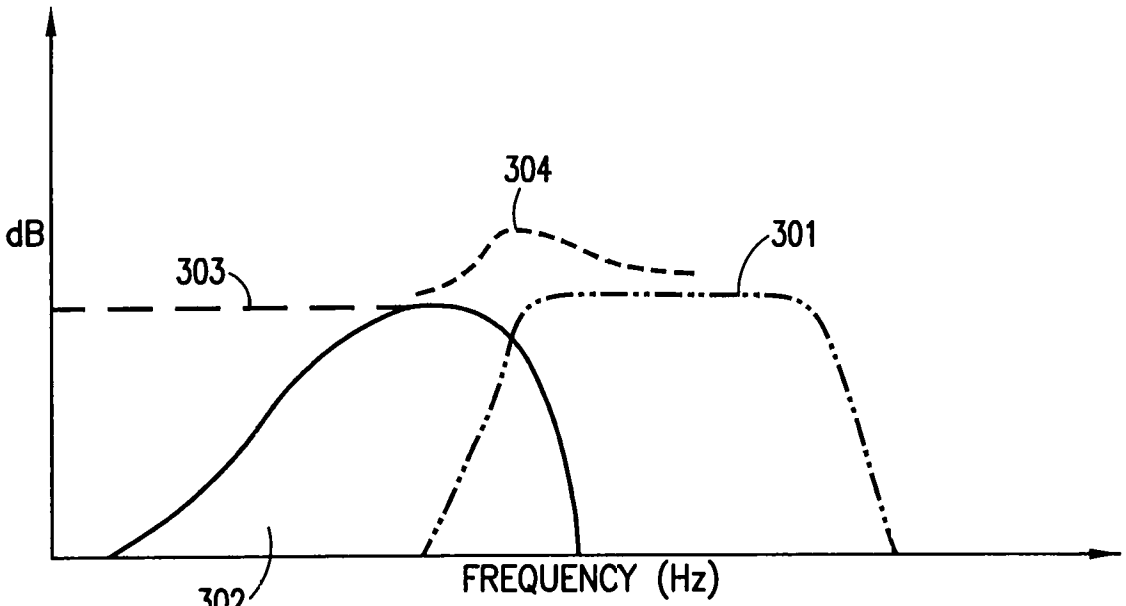
FIG. 9 is a sound level response diagram according to exemplary embodiments.

FIG. 9 depicts a sound level response of the earpiece 101 of the embodiments of FIGS. 6-8. Diagram 301 illustrates a sound level produced by the earpiece 101. Diagram 302 illustrates a sound level produced by the IHF 102. An increased bass response 303 and, therefore, wider response of the earpiece transducer can be seen from the diagrams 301 and 302. Moreover the common area yielding to increased bass response as indicated by a dotted line 304.

The wireless communication device can be a mobile hand-held terminal operable in mobile communications network. However there are various ways to implement the wireless communication device. The mobile phone 100 is an example of the wireless communication device where the embodiments can be applied.

Figure 11:
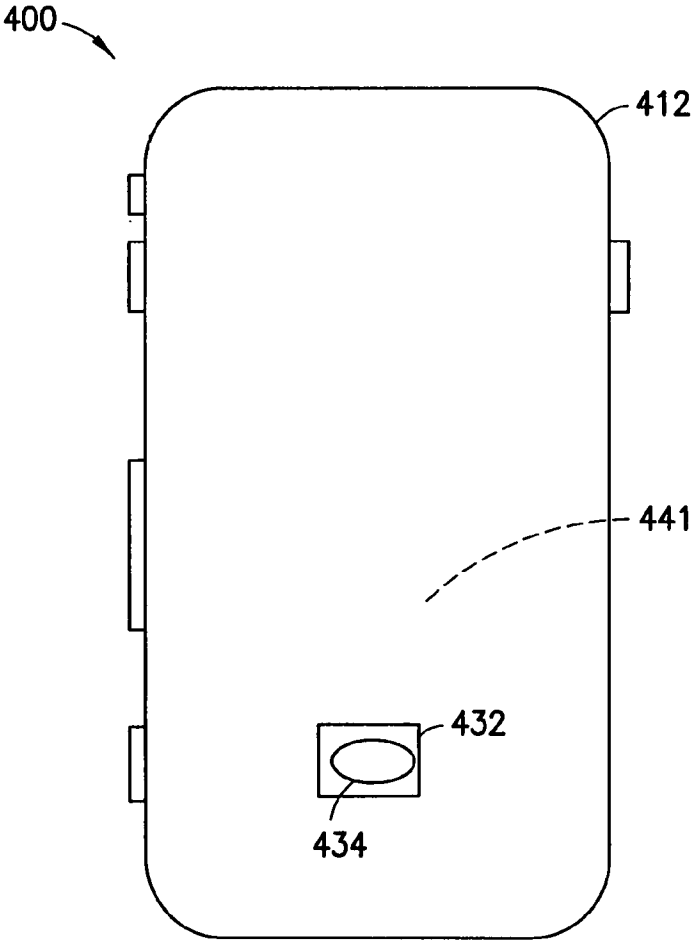
FIG. 11 is a rear view of the electronic device shown in FIG. 10.
Figure 10:
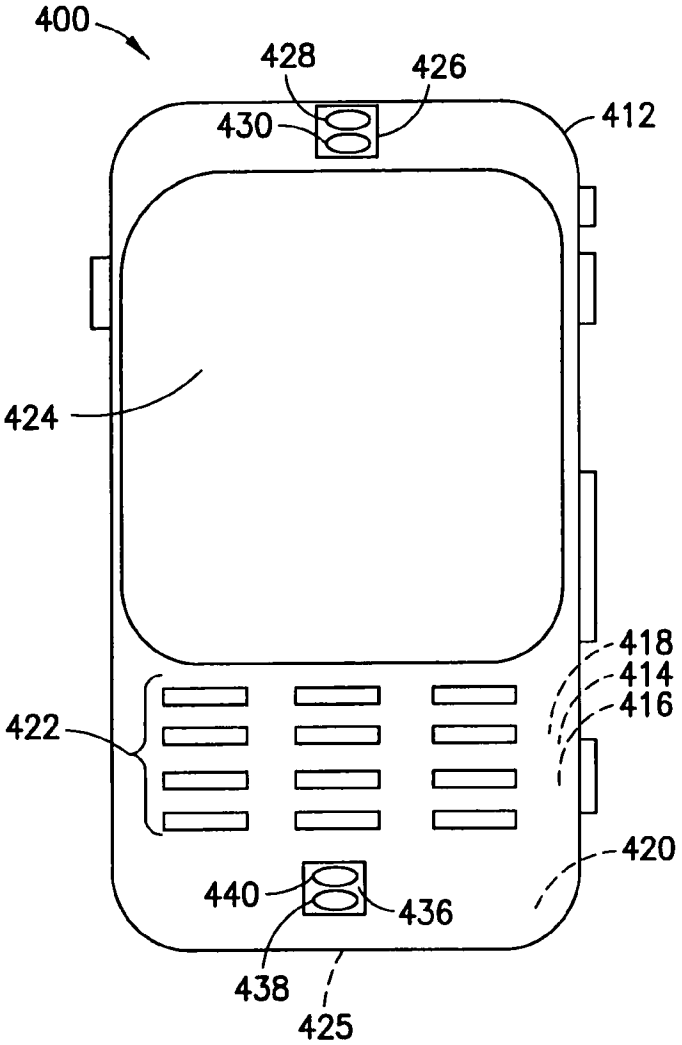
FIG. 10 is a front view of an alternate embodiment of an electronic device incorporating features of the invention.

Referring now to FIGS. 10 and 11, there are shown front and rear views of an electronic device 400 incorporating features of the invention. Although the invention will be described with reference to the exemplary embodiments shown in the drawings, it should be understood that the invention can be embodied in many alternate forms of embodiments. In addition, any suitable size, shape or type of elements or materials could be used.

According to one example of the invention, and similar to the devices 10, 100, the device 400 is a multi-function portable electronic device. However, in alternate embodiments, features of the various embodiments of the invention could be used in any suitable type of portable electronic device such as a mobile phone, a gaming device, a music player, a notebook computer, or a personal digital assistant, for example. In addition, as is known in the art, the device 400 can include multiple features or applications such as a camera, a music player, a game player, or an Internet browser, for example. The device 400 generally comprises a housing 412, a transmitter 414, a receiver 416, an antenna 418 (connected to the transmitter 414 and the receiver 416), electronic circuitry 420, such as a controller (which could include a processor, for example) and a memory for example, within the housing 412, a user input region 422, a display 424, and a microphone 425. It should be understood that although the user input region 422 is illustrated as a keypad, various exemplary embodiments of the invention may include touch-screen technology at the user input region 422. The display 424 could also form a user input section, such as a touch screen. It should be noted that in alternate embodiments, the device 400 can have any suitable type of features as known in the art.

The device 400 further includes a sound reproduction system 441 comprising a first earpiece 426 having sound outlets 428, 430, an integrated hands-free (IHF) speaker 432 having a sound outlet 434, and a second earpiece 436 having sound outlets 438, 440.

Figure 12:
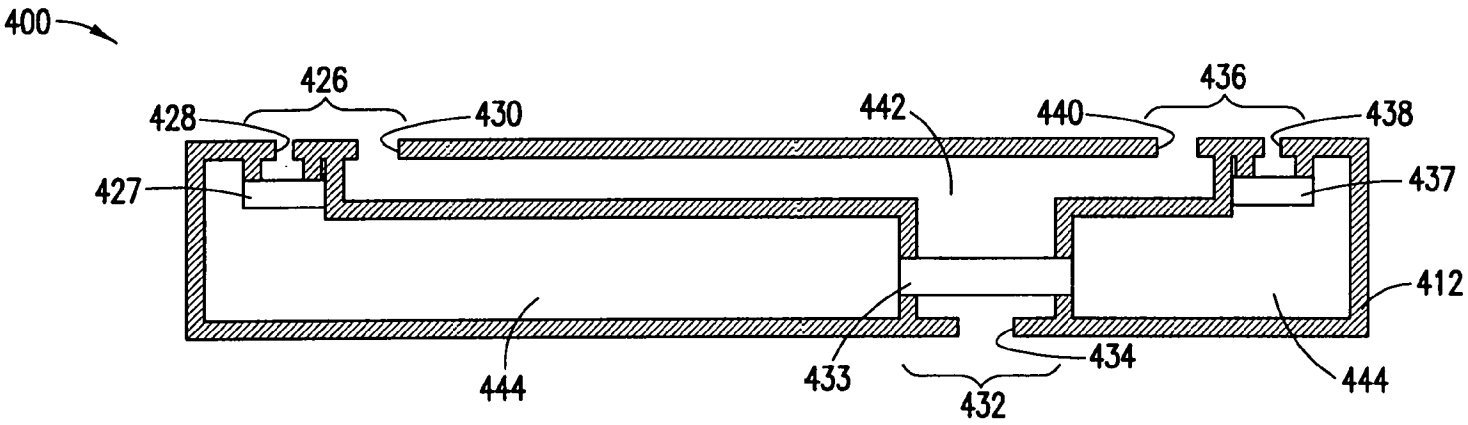
FIG. 12 is a section view of the electronic device shown in FIG. 10.
Figure 13:
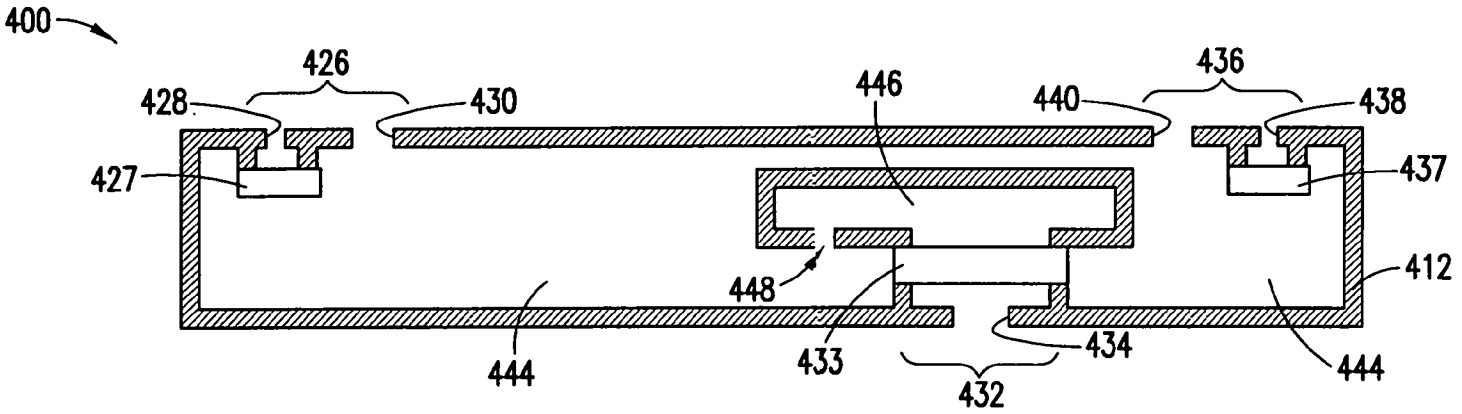
FIG. 13 is a section view of an alternate embodiment of an electronic device incorporating features of the invention.
Figure 15:
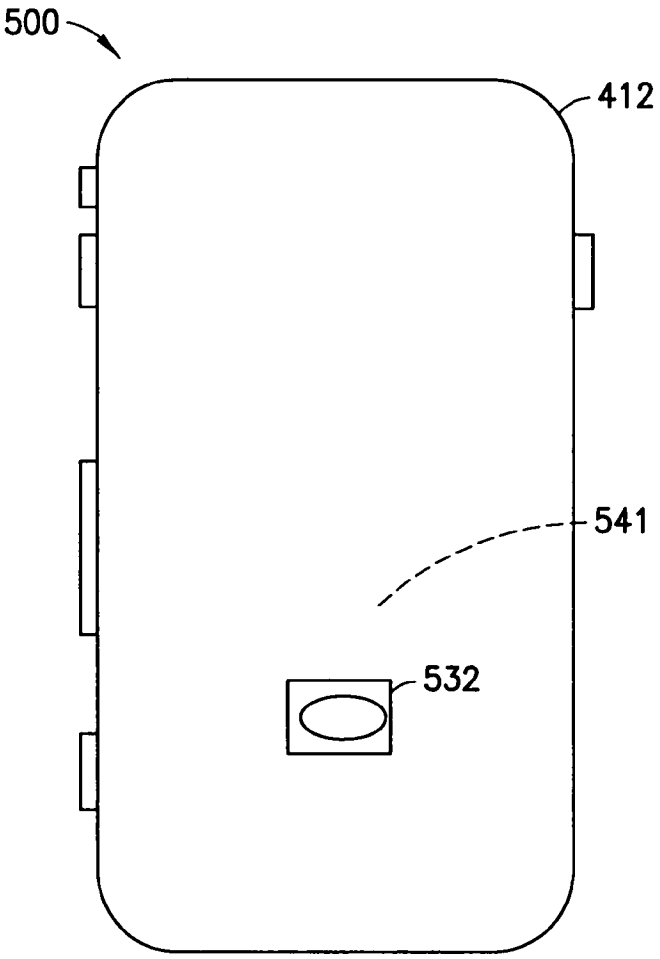
FIG. 15 is a rear view of the electronic device shown in FIG. 14.
Figure 14:
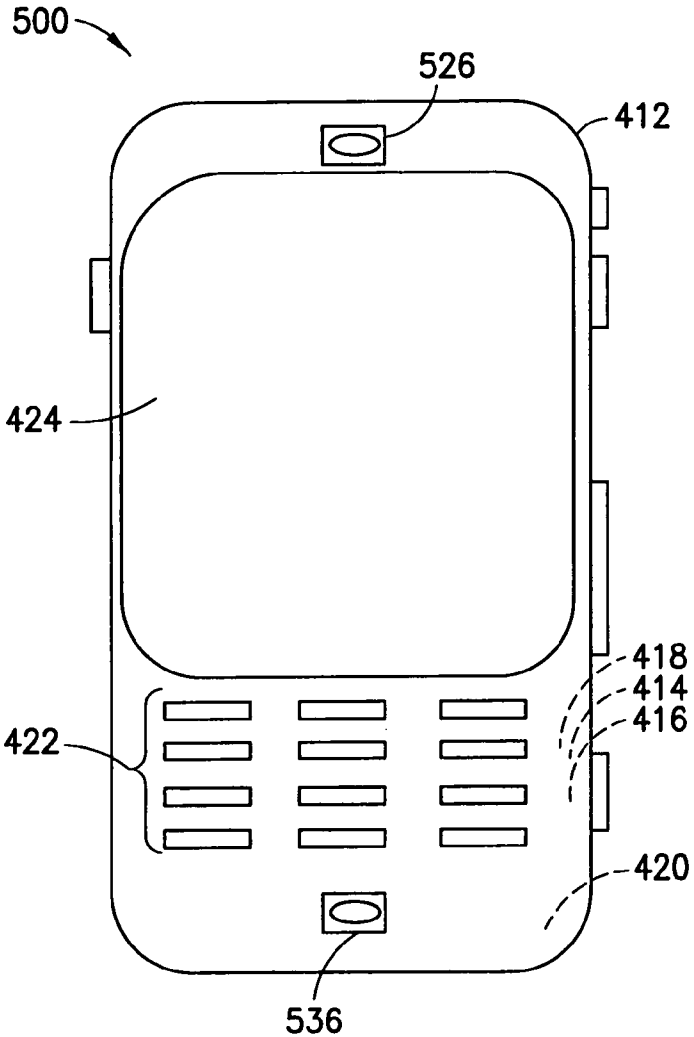
FIG. 14 is a front view of an alternate embodiment of an electronic device incorporating features of the invention.

Referring now also to FIG. 12, there is shown a section view of the device 400. The section view further illustrates the earpieces 426, 436 and the integrated hands-free 432. The earpieces 426, 436 each further comprise an earpiece loudspeaker 427, 437. The loudspeaker 427 is configured to produce sound through the sound outlet 428. The loudspeaker 437 is configured to produce sound through the sound outlet 438. The integrated hands-free (IHF) 430 also comprises a loudspeaker 433 that is enclosed in a back cavity 442, and is configured to produce sound through the sound outlet 434. According to various exemplary embodiments of the invention, the back cavity 442 is acoustically connected to the earpieces 426, 436 through the sound outlets 430, 440. Generally this provides for the user's ear to be coupled to both outlets 428 and 430, or 438 and 440, respectively. Additionally, in some embodiments of the invention, the IHF loudspeaker 433 can emit sound also to the earpieces 426, 436 through the back cavity 438.

As shown in FIG. 12, the back cavity 442 is in direct fluid communication with the sound outlets 430, 440. However, one skilled in the art will appreciate that various exemplary embodiments of the invention are not necessarily so limited and that in some exemplary embodiments a direct connection may not be provided between the back cavity and the sound outlets 430, 440. For example, referring now also to FIG. 13, there is shown another (more space-efficient) embodiment of the invention. In this example embodiment, there is no direct connection between the back cavity and the earpieces, but instead the lowest frequencies are generally leaked into the internal air space 444 inside the mobile device 400, and from there further to the additional earpiece sound outlets 430, 440. According to some embodiments of the invention, to maintain proper and well-controlled operation of the IHF in its intended frequency range (generally about 800 Hz and above), the back cavity 446 is equipped with an opening 448 that forms an acoustic low-pass filter together with it. This acoustic filter is tuned to a frequency that lies below the intended frequency range of the IHF, but still high enough (for example, about 600 Hz) to come close to the frequency at which the earpiece loudspeakers 427, 437 take over. Opening 448 may include an acoustic damping element (for example, porous textile). According to some embodiments of the invention, a cover of the device is substantially airtight with the remainder of the housing of the device, so that low frequencies actually reach the ear rather than leak out into the ambient air through various leaks in the cover. The outlets 430, 440 are configured to be large enough so that the pressure inside the internal air space 444 does not reach levels that may damage the earpiece loudspeakers 427, 437. Outlets 430, 440 may include acoustic damping elements (for example, porous textile). However, it should be noted that in some other alternate embodiments, the earpiece loudspeakers may be acoustically isolated from the internal air space 444 (which generally would require more space inside the device). It should be noted that in the embodiment shown in FIG. 13, the internal air space 444 may act as a dedicated cavity that is also a back cavity for the earpiece(s). However, a difference between the cavity 444 in FIG. 13 and in FIG. 12 is that in the latter case the cavity does not generally need to be a proper dedicated cavity. In other words, it may not play a significant role in the acoustical construction. However, cavity 444 in FIG. 13 does generally provide sufficient sealing, and does generally play a role in the acoustics.

From the foregoing it will be seen that the embodiment shown in FIG. 12 illustrates a solution that generally performs better acoustically (for example, bass can be reproduced in the earpieces at a higher level), but is generally suboptimal in regards to use of space inside the device. Whereas the embodiment show in FIG. 13, on the other hand, illustrates a solution that can be made very space-efficient (for example, potentially no extra space used compared to a conventional solution), but the bass output level of the earpieces is generally lessened when compared to the embodiment shown in FIG. 12. Additionally, according to various exemplary embodiments, the earpiece sound outlets 428, 438 generally reproduce midrange and high frequencies, while the outlets 430, 440 generally reproduce low frequencies. Furthermore, in some embodiments of the invention a filtered signal containing only the low frequencies is fed to the IHF, while the high and midrange frequencies are sent to the earpieces.

Similar to the device 10, 100 the mobile device 400 includes a masking system (or the sound reproduction system) 441. According to various exemplary embodiments of the invention, the masking system is connected to the earpieces and the IHF such that the masking system is configured to provide a masking signal to prevent privacy loss by using another loudspeaker to emit a simultaneous signal that masks the leaking downlink speech. Additionally, it should be noted that in some embodiments, the earpieces 426, 436 receive the same signal (for example, the earpieces 426, 436, reproduce the same downlink speech signal). However, in some other embodiments, the earpieces 426, 436, may be configured to be independent, such that the earpieces 426, 436 can receive different (downlink speech) signals, and therefore the masking signal can be sent (wholly or partially) also to the other earpiece (such as the earpiece that is not on the user's ear). Furthermore, in some embodiments, any suitable type of proximity detection may be provided to check which earpiece is the "active" one.

While various exemplary embodiments of the invention have been described above in connection with two earpieces which are connected to each other and the IHF through a back cavity and/or internal air space of the device, one skilled in the art will appreciate that various embodiments of the invention are not necessarily so limited and that in some embodiments the earpieces and IHF are separate (such that they are not connected through any tubes, cavities, and/or internal air space). For example, referring now to FIGS. 14, 15, there is shown a device 500. The device 500 is similar to the device 400 and similar features are similarly numbered. However, in this embodiment, the earpieces 526, 536 and the IHF 532 are separate. For example, in this embodiment, the earpieces 526, 536, and the IHF 532 are not connected through a back cavity of the IHF and/or internal air space of the device. Similar to the device 400, the device 500 comprises a masking system (or sound reproduction system) 541. According to various exemplary embodiments of the invention, the masking system is connected to the earpieces and the IHF such that the masking system is configured to provide a masking signal to prevent privacy loss by using another loudspeaker to emit a simultaneous signal that masks the leaking downlink speech. For example, with the earpieces working as usual to reproduce downlink speech, a masking signal is also sent to the IHF at the same time. This is especially beneficial if both earpieces are always active at the same time (to allow the user to switch orientation at will), as there is then also more leakage of downlink speech. Additionally, it should be noted that in some embodiments, the earpieces 526, 536 receive the same signal (for example, the earpieces 526, 536, reproduce the same downlink speech signal). However, in some other embodiments, the earpieces 526, 536, may be configured to be independent, such that the earpieces 526, 536 can receive different (downlink speech) signals, and therefore the masking signal can be sent (wholly or partially) also to the other earpiece (such as the earpiece that is not on the user's ear). Furthermore, in some embodiments, any suitable type of proximity detection may be provided to check which earpiece is the "active" one.

According to various exemplary embodiments of the invention, various sensors may be provided to detect which earpiece is held against the user's ear. Further, in some embodiments of the invention, the unused earpiece can at the same time be used to emit a special masking signal to further reduce (or eliminate) loss of privacy, provided that the microphone(s) used for pickup of uplink speech are not too close to this earpiece, and/or that this additional noise is eliminated by digital signal processing. Additionally, in some other embodiments of the invention, wherein for example a failsafe method of detecting the proper earpiece is difficult (such as due to lack of reliable sensor input, for example), both earpieces may reproduce the same signal at the same time. However, this may produce a higher loss of privacy for the user of the device. In some various exemplary embodiments of the invention, an additional feature may be provided to alleviate the loss of privacy when both earpieces 426, 436 (or 526, 536) produce the same signal. For example, some embodiments of the invention may provide for the IHF to reproduce a mix of both the low-pass filtered earpiece signal and a masking signal (which, for example, could be provided as the signals would have essentially different frequency ranges).

Figure 18:
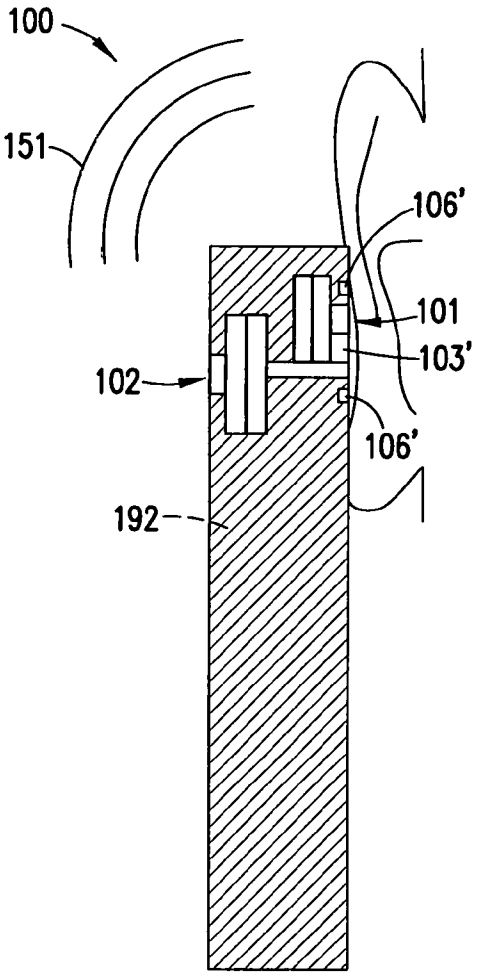
FIGS. 16-20 are partial section views of exemplary embodiments.
Figure 17:
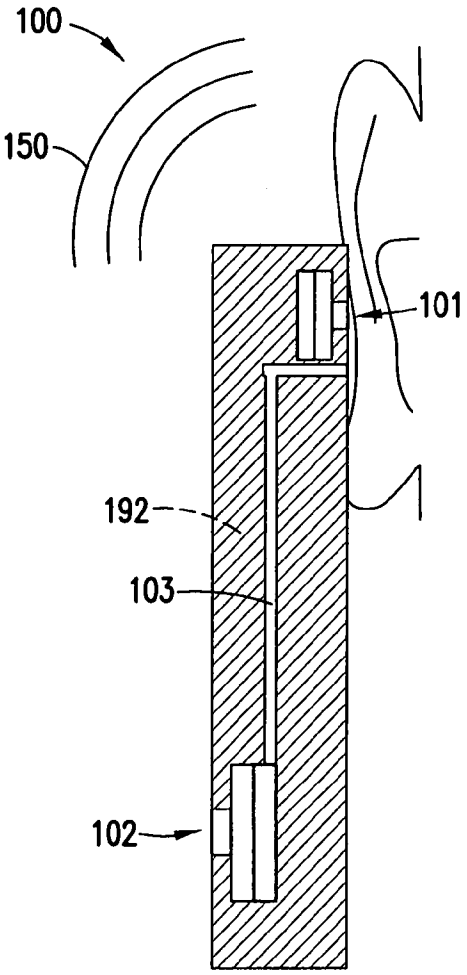
Figure 16:
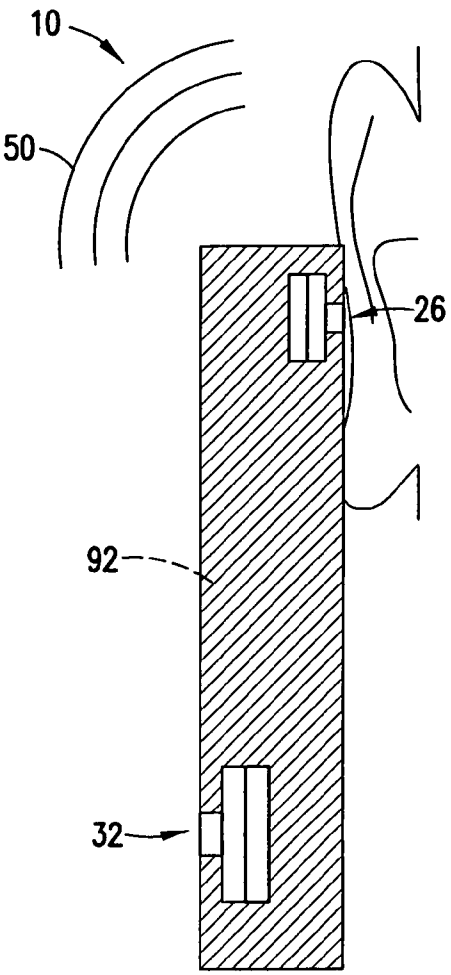
Figure 20:
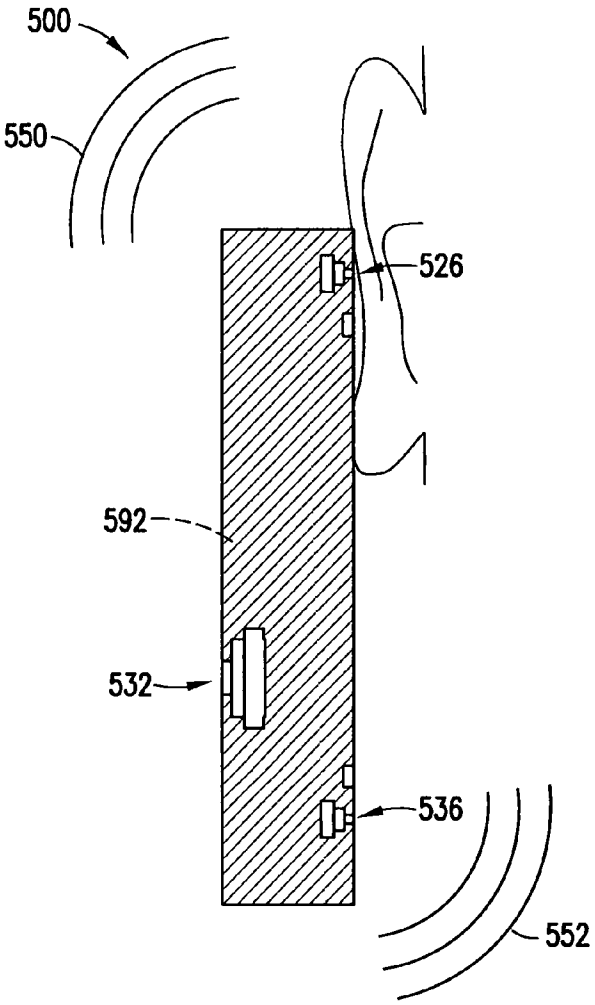
Figure 19:
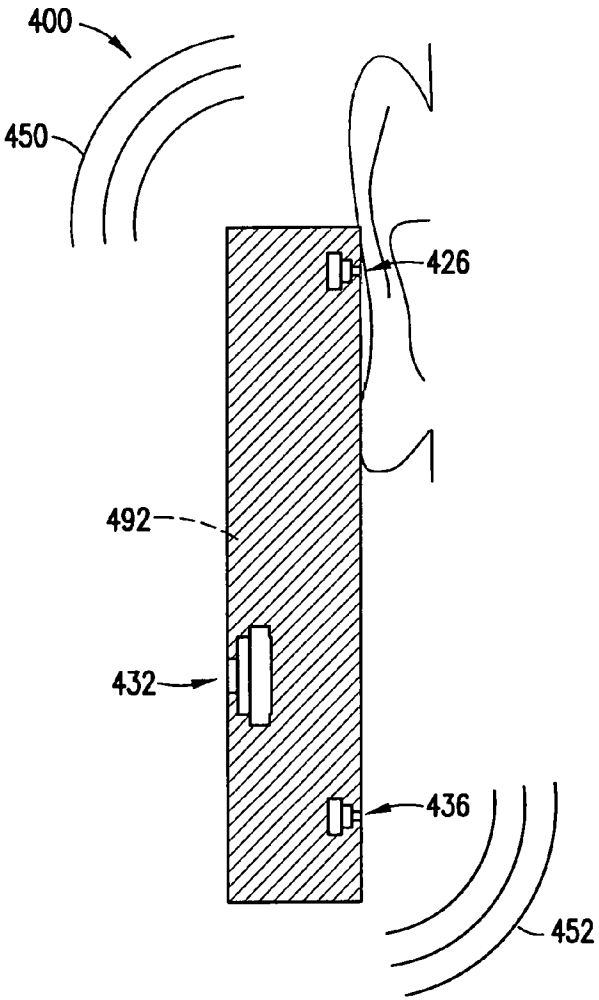

Referring now also to FIGS. 16-20, there are shown a partial section views of the mobile device 10, 100, 400, 500 held against a user's ear. It should be noted that FIGS. 16-20 are provided as simplified drawings and that in these figures, the back cavity of the IHF speaker, and the open back of the earpiece speaker are not shown for the purposes of clarity. In FIG. 16, the sound waves 50 outside the earpiece 26 represent the leakage of downlink sound reproduced by the earpiece 26 (with the majority of the downlink sound from the loudspeaker 27 generally captured by the user's outer ear). In FIG. 17, the sound waves 150 outside the earpiece 101 represent the leakage of downlink sound reproduced by the earpiece 101. In FIG. 18, the sound waves 151 outside the earpiece 101 represent the leakage of downlink sound reproduced by the earpiece 101. In FIG. 19, the sound waves 450 outside the earpiece 426 represent the leakage of downlink sound reproduced by the earpiece 426 (with the majority of the downlink sound from the loudspeaker 427 generally captured by the user's outer ear). The sound waves 452 outside the earpiece 436 represent the 'leakage' of downlink sound reproduced by the earpiece 436 (or the earpiece not against the user's ear). In FIG. 20, the sound waves 550 outside the earpiece 526 represent the leakage of downlink sound reproduced by the earpiece 526 (with the majority of the downlink sound from the loudspeaker 527 generally captured by the user's outer ear). The sound waves 552 outside the earpiece 536 represent the 'leakage' of downlink sound reproduced by the earpiece 536 (or the earpiece not against the user's ear). It should be noted that any references made to "leaking speech" or "leaking sound" throughout the specification/drawings can apply to the sound waves 50, 150, 151, 450, 452, 550 and/or the sound waves 552.

According to various exemplary embodiments, the downlink speech may be analyzed by a digital signal processor (DSP) 92, 192, 492, 592 of the device 10, 100, 400, 500 and the result of this analysis may be used to control the temporal envelope, spectrum, and level of a masking noise signal that is sent simultaneously to the other loudspeaker (for example, the integrated hands-free speaker).

According to various exemplary embodiments of the invention, the masking signal may also be filtered according to the frequency response of the earpiece as measured at a given convenient distance and angle from the device (such as, about 1 m, for example), when the device 10, 100, 400, 500 is held by hand against the user's ear (which could of course also be an artificial head and torso simulator). This frequency response generally has a very strong attenuation at low frequencies. Further correction is made according to the frequency response of the IHF as measured at the same point (which is not necessarily even, especially since some shadowing of the IHF 32, 102, 432, 532 due to the user's head and hand may also be present). This way, the masking signal, as reproduced by the IHF 32, 102, 432, 532 produces roughly the same average spectrum and level as the 'leaking' speech from the earpiece 26, and/or the 'leaking' speech/sound reproduced by the earpiece 101, the tubular cavity 103, 103', the leak holes 106', the earpiece 436, 536. This is generally pertinent as an overly loud masking signal may simply be annoying to the user and/or others close nearby, and it may interfere with pickup of uplink speech, without producing any further benefit for reduction of privacy loss.

Figure 21:
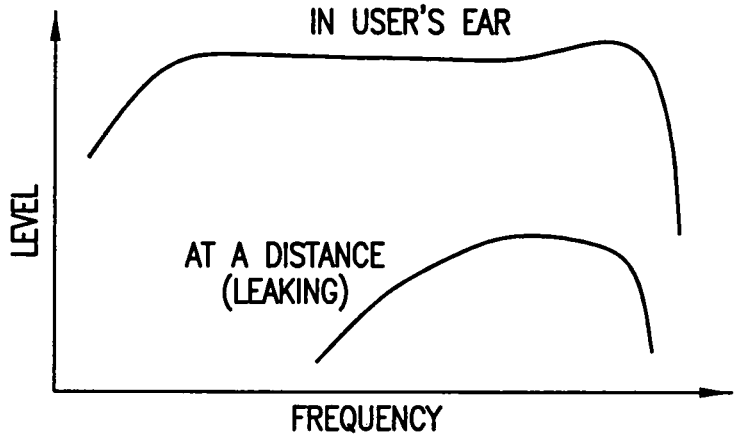
FIGS. 21-23 are frequency response diagrams according to exemplary embodiments.
Figure 22:
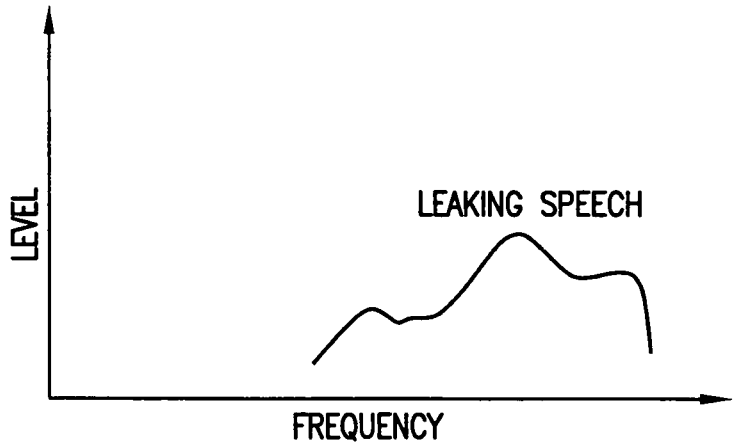
Figure 23:
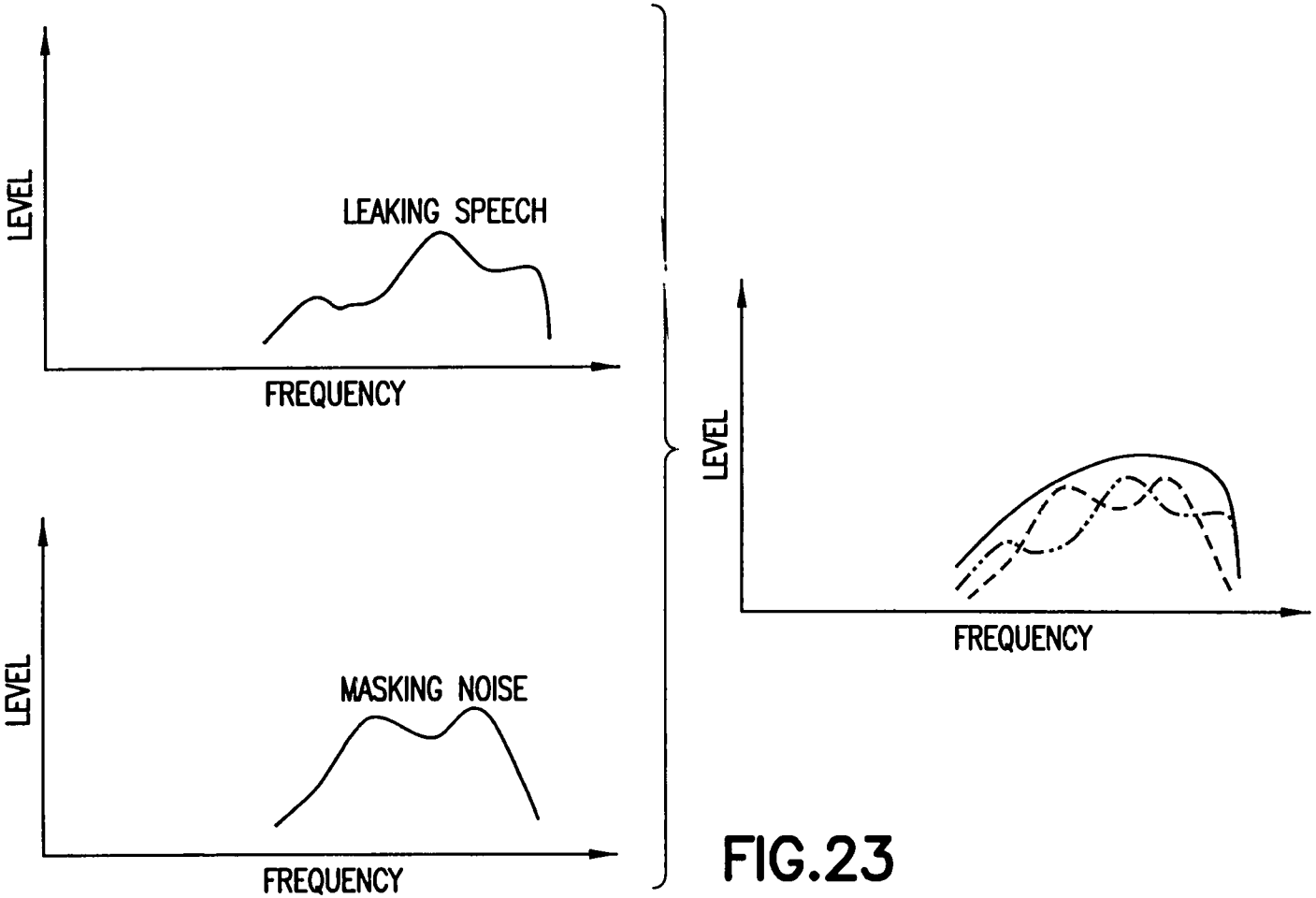

Referring now also to FIGS. 21-23, there are shown various frequency response graphs pertaining to exemplary embodiments of the invention. FIG. 21 shows two frequency response graphs, of which the upper frequency response graph represents the reproduction of downlink speech in the user's ear, and the lower frequency response graph represents downlink speech leaking outside the phone. The much lower level, and different spectrum, of the leaking sound (such as the sound illustrated by the sound waves 50, 150, 151, 450, 452, 550, 552) should be observed. FIG. 22 shows an example of what the spectrum of the leaking sound could look like at some given instant in time. It should be observed that the frequency content of this sound varies all the time (without any variation, it would of course not even be intelligible). FIG. 23 shows how, by reproducing a signal that is derived from the instantaneous downlink signal being sent to the earpiece, one can mask the temporal variation of the spectrum of the leaking sound, and thus render it unintelligible. As shown in FIG. 23, the masking sound is not necessarily higher in level, but simply adds up to a stationary or almost stationary spectrum together with the leaking speech.

In a practical applications, several points at different angles, and a few different distances, are used to measure the frequency responses mentioned above. This way the best overall compromise can be found. The masking signal may be modulated by the downlink speech so that the leaking speech 50, 150, 151, 450, 452, 550, 552 and the masking signal sum up to about spectrally even (apart from the natural attenuation of low frequencies mentioned above) noise at a distance from the device 10, 100, 400, 500 and the user's head (see FIG. 23). To further prevent this summed sound (now simply unintelligible noise) from being too obtrusive and annoying to surrounding people, the masking signal may also follow the level of the downlink speech (using a suitable time constant, such as, a couple of seconds, for example).

Furthermore, the masking signal can be attenuated whenever the user is speaking, and/or when there is considerable background noise (during these situations privacy loss is not an issue since the downlink speech is drowned out anyway). To enable this, the algorithm could also be following the signal from the microphone(s) in the device 10, 100, 400, 500. Another reason for doing this is that the masking signal would otherwise interfere with uplink speech pickup and uplink noise attenuation when both parties are speaking at the same time.

Additionally, according to some embodiments of the invention, a simplified 'brute-force' method may be to simply reproduce stationary masking noise through the IHF. This method has the disadvantage that, due to the stationary nature of this noise, it also has to be reproduced at a higher level in order to completely render the leaking downlink speech unintelligible.

Various exemplary embodiments of the invention provide a method to prevent privacy loss by using another loudspeaker (such as, the integrated hands-free loudspeaker, for example) to emit a simultaneous signal that masks the leaking downlink speech. The properties of this masking signal are chosen so that it severely impairs or completely prevents intelligibility of the leaking speech, while at the same time being as unobtrusive as possible.

Technical effects of any one or more of the exemplary embodiments provide significant improvements when compared to conventional configurations. For example, when the user of a mobile device is engaging in a call, holding the device against his/her ear, some of the downlink speech is usually leaking out into the surroundings. This leakage happens partly between the device and the user's outer ear (this connection is practically never fully acoustically sealed), and partly from inside the device itself, since the earpiece loudspeaker is generally not enclosed in any airtight cavity. While the leaking downlink speech is usually severely lacking low frequencies at a typical listening distance from the user engaged in a call, and therefore mostly consonants are heard, this still compromises privacy since the leaking speech can be quite intelligible.

Loss of privacy is generally a problem in conventional single-loudspeaker solutions, where most of the sound generated by the loudspeaker has to be directed away from the ear in order to protect against so-called acoustic shock.

Technical effects of any one or more of the exemplary embodiments provide for making downlink speech completely unintelligible without too severely increasing the loudness of the sound emitted into the surroundings, if the parameters of the algorithms producing the masking signal are chosen optimally (only as much masking signal as needed and no more). Technical effects of any one or more of the exemplary embodiments also provide that the prevention of privacy loss does not depend on the position of the device on the user's ear, or on the direction of the listener(s), if the parameters are chosen optimally, for example, the parameters could be chosen according to the worst case, which is the direction into which the most intelligible sound is emitted by the earpiece, and the most shadowing is happening to the IHF. Another technical effect of one or more of the example embodiments is that no extra hardware is needed, and there are no added requirements on the audio components and their integration. However, it should be noted that the loudspeaker emitting the masking sound should not be too close to the microphone(s) used for pickup of speech (and background noise) in handportable mode. Additionally, the average level of sound emitted into the surroundings during downlink speech is somewhat higher than without a masking signal.

Figure 24:
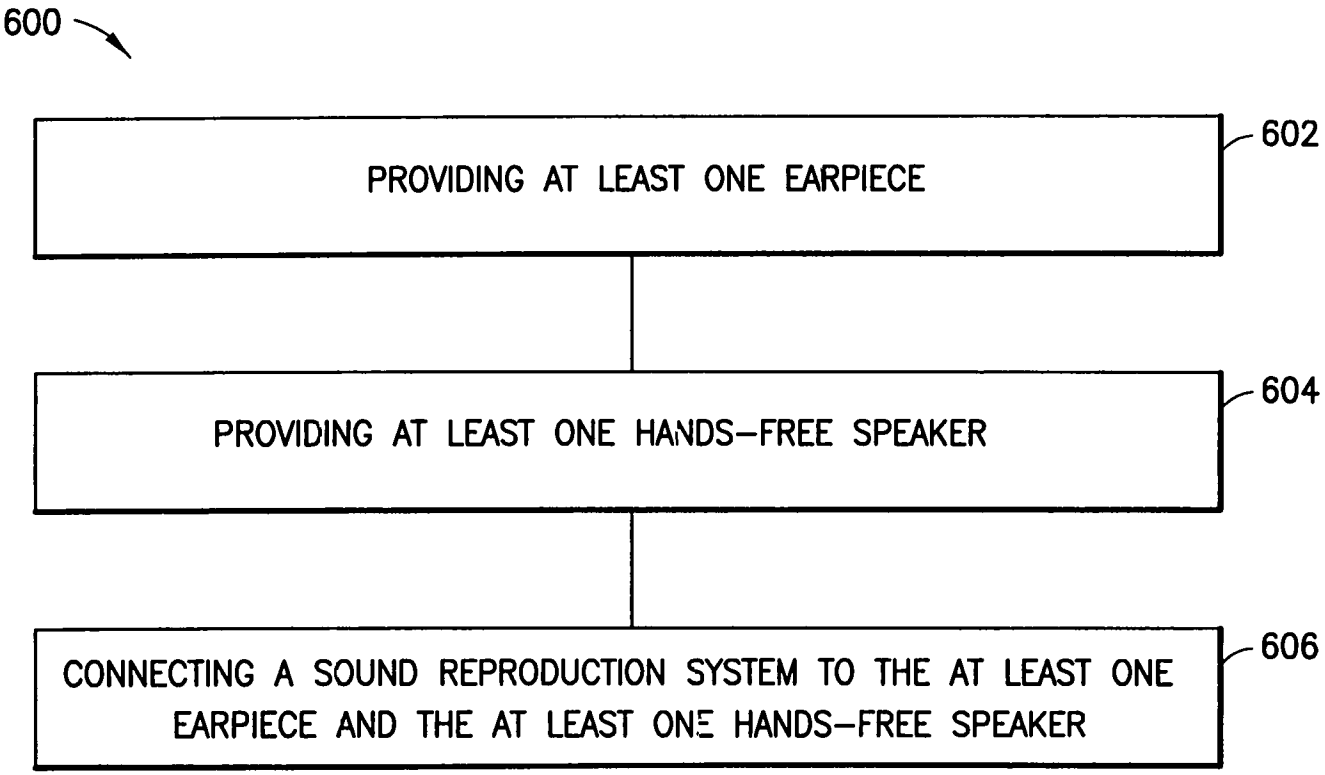
FIG. 24 is a block diagram of an exemplary method according to exemplary embodiments.

FIG. 24 illustrates a method 600. The method 600 includes providing at least one earpiece (at block 602). Providing at least one hands-free speaker (at block 604). Connecting a sound reproduction system to the at least one earpiece and the at least one hands-free speaker, wherein the sound reproduction system is configured to provide a downlink audio signal to the at least one earpiece and a corresponding audio signal based on the downlink audio signal to the at least one hands-free speaker (at block 606). It should be noted that the illustration of a particular order of the blocks does not necessarily imply that there is a required or preferred order for the blocks and the order and arrangement of the blocks may be varied. Furthermore it may be possible for some blocks to be omitted.

Figure 25:
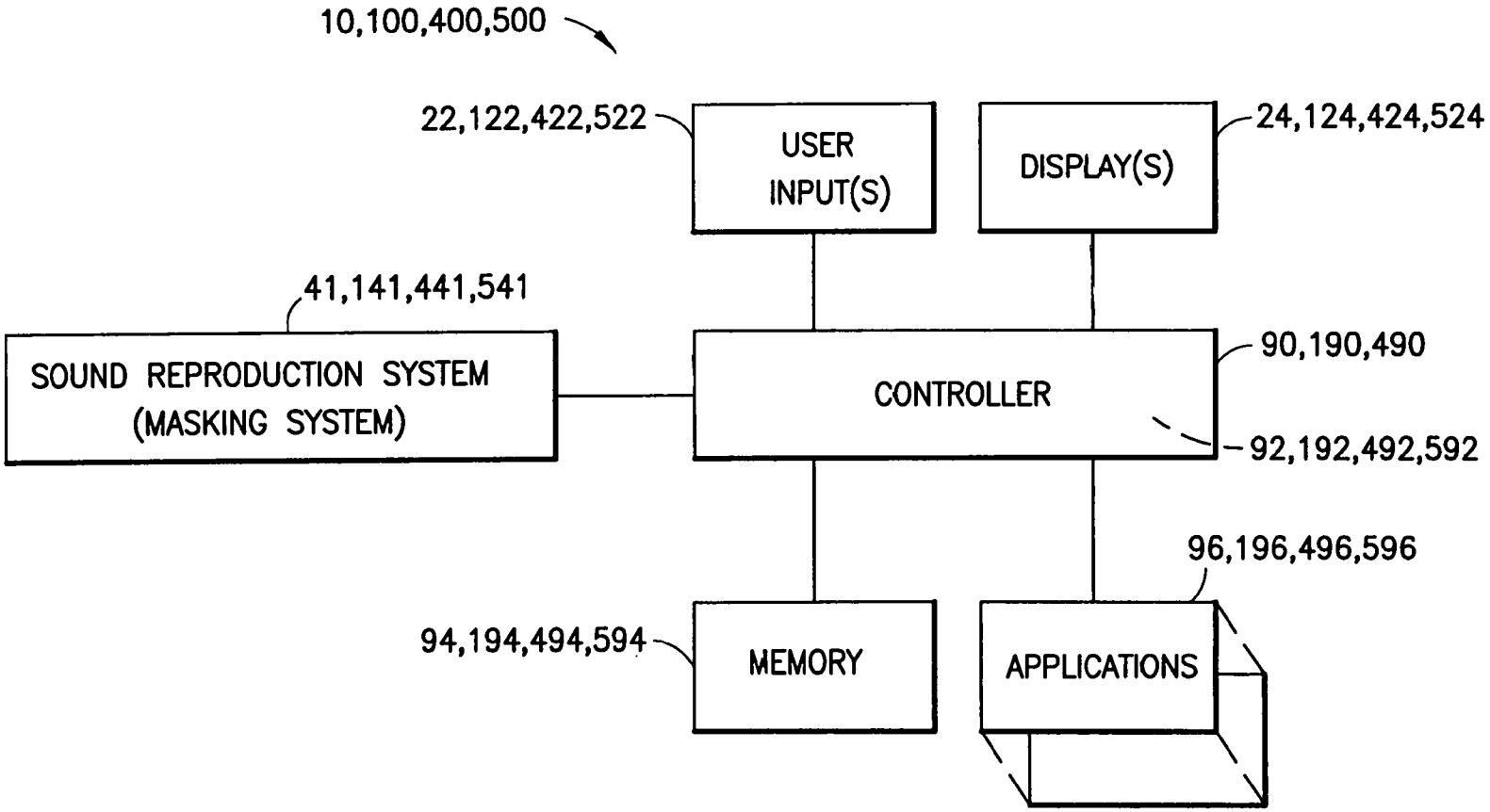
FIG. 25 is a schematic drawing illustrating components of exemplary embodiments.

Referring now also to FIG. 25, the device 10, 100, 400, 500 generally comprises a controller 90, 190, 490, 590 such as a microprocessor for example. The microprocessor may be of any type suitable to the local technical environment, and may include the digital signal processor (DSP) 92, 192, 492, 592 for example. Additionally, microprocessor may further include one or more of general purpose computers, special purpose computers, microprocessors, additional digital signal processors (DSPs) and processors based on a multicore processor architecture, as non-limiting examples. The electronic circuitry includes a memory 94, 194, 494, 594 coupled to the controller 90, 190, 490, 590 such as on a printed circuit board for example. The memory could include multiple memories including removable memory modules for example. The memory may further include any suitable computer readable memory and may be of any type suitable to the local technical environment and may be implemented using any suitable data storage technology, such as semiconductor based memory devices, flash memory, magnetic memory devices and systems, optical memory devices and systems, fixed memory and removable memory. The device has applications 96, 196, 496, 596 such as software, which the user can use. The applications can include, for example, a telephone application, an Internet browsing application, a game playing application, a digital camera application, a map/gps application, etc. These are only some examples and should not be considered as limiting. One or more user inputs 22, 122, 422, 522 are coupled to the controller 90, 190, 490, 590 and one or more displays 24, 124, 424, 524 are coupled to the controller 90, 190, 490, 590. The masking system 41, 141, 441, 541 (which is connected to the earpiece loudspeaker(s) and the IHF loudspeaker) is also coupled to the controller 90, 190, 490, 590. The device 10, 100, 400, 500 may programmed to automatically emit (or radiate) a masking signal. However, in an alternate embodiment, this might not be automatic. The user might need to actively select a function to emit the masking signal.

It should be noted that although the figures show the earpiece(s) at front face of the device and the IHF at the rear face of the device, in alternate embodiments the earpiece(s) and/or the IHF may be provided at any suitable location of the device. Additionally, while various exemplary embodiments of the invention have been described in connection with emitting a masking signal when the device is oriented such that the earpiece 426, 526 is at the user's ear, one skilled in the art will appreciate that the various exemplary embodiments are not necessarily so limited and that in alternate embodiments a masking signal may be emitted when the device is oriented such that the earpiece 436, 536 is at the user's ear.

Various exemplary embodiments of the invention provide an earpiece solution for a mobile device that can be used in two orientations. Additionally, various exemplary embodiments relate to earpiece sound reproduction primarily in speech call wherein at least two earpiece components and at least one handsfree speaker are suitably positioned so as to function together in order to improve the reproduction quality and orientation free handset usage.

As described above, various exemplary embodiments of the invention comprise one, two (or more) earpieces and an integrated hands-free loudspeaker that are acoustically configured in a given manner. The earpiece loudspeakers are generally small in size (for example, considerably smaller than a conventional earpiece loudspeaker) and in some embodiments reproduce high and midrange frequencies only (for example, in some embodiments of the invention, the earpiece loudspeakers do not go down to about 200 Hz, such as in conventional earpieces). Technical effects of any one or more of the exemplary embodiments provide for each earpiece to include a sound outlet that is connected to an internal air cavity inside the device, where the air cavity is coupled to the integrated hands-free (IHF) loudspeaker, which during handportable use reproduces low frequencies only. Technical effects of any one or more of the exemplary embodiments provide for the air cavity to double as the rear enclosure of the IHF loudspeaker, in order to save space. Technical effects of any one or more of the exemplary embodiments provide for the earpieces to both reproduce the same audio all the time, or sensor input may be used to determine which earpiece should be the active one (with the other one silenced, or reproducing special masking signal). Technical effects of any one or more of the exemplary embodiments may also provide for reproducing the masking signal through the IHF.

Without in any way limiting the scope, interpretation, or application of the claims appearing below, a technical effect of one or more of the example embodiments disclosed herein is that since the earpiece loudspeakers do not need to reproduce low frequencies, they can easily be smaller and/or cheaper than conventional earpiece loudspeakers in an identical device. Dimensions of each earpiece loudspeaker can be smaller because the maximum volume displacement of these loudspeakers can be reduced, as they do not need to reproduce low frequencies. Furthermore, their magnet system can be smaller (and therefore also less expensive) because the moving mass of these loudspeakers can be smaller, again for the reason that they do not need to reproduce low frequencies. Another technical effect of one or more of the example embodiments disclosed herein is that the privacy loss that could otherwise result when also the IHF loudspeaker is engaged is significantly reduced by restricting the output of the IHF to low frequencies only. This severely impairs intelligibility of the "leaked" downlink speech, which is desired in order to preserve as much privacy as possible. Another technical effect of one or more of the example embodiments disclosed herein is that the cavity to which the additional sound outlets in the earpieces are connected can potentially be the rear enclosure (such as, the back cavity, for example) of the IHF loudspeaker, which means that no extra space is needed inside the device.

Another technical effect of one or more of the example embodiments disclosed herein is providing a mobile device that can be used in two alternative, opposite, orientations. This means that not just one end, but both, can be held against the ear and during a call, and acceptable earpiece performance is achieved in both orientations. Various exemplary embodiments of the invention provide significant advantages over configurations which would merely utilize two earpieces, as this would require more volume inside the device, and also additional cost. Accordingly, another technical effect of one or more of the example embodiments disclosed herein is reducing both the cost and the space requirements inside the device (without earpiece sound quality suffering).

Another technical effect of one or more of the example embodiments disclosed herein is that the cavity that feeds low frequencies into the earpieces may be generally large in one dimension, since it may extend all the way from the IHF loudspeaker to the earpieces. However, it should be noted that, in some embodiments, a long tube may instead be provided, in which case the cavity may not necessarily be large in one dimension. Another technical effect of one or more of the example embodiments disclosed herein is provided by letting the free air space inside the device be a "back cavity" for the IHF, which may be somewhat challenging for high frequencies due to all the complex cavities and narrow channels inside the body of the device, but much less challenging for low frequencies. Another technical effect of one or more of the example embodiments disclosed herein is that the earpiece loudspeakers are generally smaller than in the conventional configurations, and they may also have a lacking bass response (for example, they might produce full output only down to about 800 Hz, for example, rather than a more typical frequency of about 200-400 Hz).

It should be noted that, various embodiments of the invention have been described in connection with the device emitting a masking signal, however one skilled in the art will appreciate that the term 'emit' or 'emitting' is not intended to be limiting and that the device may further be described as producing, reproducing, or radiating the masking signal, for example.

It should be understood that components of the invention can be operationally coupled or connected and that any number or combination of intervening elements can exist (including no intervening elements). The connections can be direct or indirect and additionally there can merely be a functional relationship between components.

As used in this application, the term 'circuitry' refers to all of the following: (a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry"

would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in server, a cellular network device, or other network device.

Embodiments of the present invention may be implemented in software, hardware, application logic or a combination of software, hardware and application logic. The software, application logic and/or hardware may reside in the device. If desired, all or part of the software, application logic and/or hardware may reside on any other suitable location. In an example embodiment, the application logic, software or an instruction set is maintained on any one of various conventional computer-readable media. In the context of this document, a "computer-readable medium" may be any media or means that can contain, store, communicate, propagate or transport the instructions for use by or in connection with an instruction execution system, apparatus, or device, such as a computer, with one example of a computer described and depicted in FIG. 25. A computer-readable medium may comprise a computer-readable storage medium that may be any media or means that can contain or store the instructions for use by or in connection with an instruction execution system, apparatus, or device, such as a computer.

Below are provided further descriptions of various non-limiting, exemplary embodiments. The below-described exemplary embodiments may be practiced in conjunction with one or more other aspects or exemplary embodiments. That is, the exemplary embodiments of the invention, such as those described immediately below, may be implemented, practiced or utilized in any combination (e.g., any combination that is suitable, practicable and/or feasible) and are not limited only to those combinations described herein and/or included in the appended claims.

According to one or more examples of the invention, the device comprises an IHF and one earpiece, wherein the earpiece and IHF are separate (not connected through any tubes etc.). The IHF works as usual, and the earpiece works as usual, but when it reproduces downlink speech, a masking signal is also sent to the IHF at the same time.

According to one or more examples of the invention, the device comprises an IHF and one earpiece, wherein the earpiece and IHF are connected by a tube/cavity, so that the earpiece's bass reproduction is improved. In addition, when the earpiece reproduces downlink speech, a masking signal is also sent to the IHF at the same time.

According to one or more examples of the invention, the device comprises an IHF and two earpieces, wherein the earpieces and IHF are separate (not connected through any tubes etc.). The IHF works as usual, and the earpieces work as usual, but when they reproduce downlink speech, a masking signal is also sent to the IHF at the same time. This is especially beneficial if both earpieces are always active at the same time (to allow the user to switch orientation at will), as there is then also more leakage. Additionally, in some embodiments, the earpieces are independent (can receive different signals), and therefore the masking signal can be sent (wholly or partially) also to the other earpiece (the one that is not on the user's ear), wherein the device may further comprise some suitable type of proximity detection to check which earpiece is the "active" one.

According to one or more examples of the invention, the device comprises an IHF and two earpieces, wherein the earpieces and IHF are connected by tubes (or a cavity), so that the earpieces' bass reproduction is improved. In addition, when the earpiece reproduces downlink speech, a masking signal is also sent to the IHF at the same time. Additionally, in some embodiments, the earpieces are independent (can receive different signals), and therefore the masking signal can be sent (wholly or partially) also to the other earpiece (the one that is not on the user's ear), wherein the device may further comprise some suitable type of proximity detection to check which earpiece is the "active" one.

In one exemplary embodiment, an apparatus comprising at least one earpiece, at least one hands-free speaker; and a sound reproduction system comprising the at least one earpiece and the at least one hands-free speaker, wherein the sound reproduction system is configured to provide a downlink audio signal to the at least one earpiece and a corresponding audio signal associated with the downlink audio signal to the at least one hands-free speaker.

An apparatus as above, wherein the corresponding audio signal is configured to reproduce low frequencies for improved audio playback.

An apparatus as above, wherein the corresponding audio signal comprises frequencies ranging about 600 Hz and below.

An apparatus as above, wherein the corresponding audio signal is configured to provide a masking signal corresponding to the downlink audio signal.

An apparatus as above, wherein the at least one earpiece comprises a first outlet and a second outlet, and wherein the at least one hands-free speaker comprises a back cavity which acoustically radiates from at least the second outlet of the at least one earpiece.

An apparatus as above, wherein the apparatus further comprises a second earpiece, wherein the second earpiece comprises a first outlet and a second outlet, and wherein the back cavity of the at least one hands-free speaker is connected to the second outlet of the second earpiece.

An apparatus as above, wherein the back cavity comprises an opening, wherein the opening forms a low pass filter.

An apparatus as above, wherein the first earpiece and the second earpiece acoustically radiate from a front face of the apparatus.

An apparatus as above, wherein the first earpiece is proximate a top end of the apparatus, and wherein the second earpiece is proximate a bottom end of the apparatus.

An apparatus as above, wherein a portion of the back cavity is proximate the top end of the apparatus, and another different portion of the back cavity is proximate the bottom end of the apparatus.

An apparatus as above, wherein the apparatus further comprises a second earpiece, wherein the sound reproduction system is configured to provide the downlink audio signal to the at least one earpiece and a corresponding audio signal based on the downlink audio signal to the at least one hands-free speaker and/or the second earpiece.

An apparatus as above, wherein the corresponding audio signal comprises at least a portion of the downlink audio signal when the sound reproduction system is configured for audio playback improvement, and wherein the corresponding audio signal comprises a masking signal associated with the downlink audio signal when the sound reproduction system is configured as a masking system.

An apparatus as above, further comprising a processor connected to the sound reproduction system, wherein the processor and the sound reproduction system are configured to cause the apparatus to perform at least the following:

analyze downlink speech emitted at the at least one earpiece, generate a masking signal in response to the analyzed downlink speech, and emit the masking signal at the at least one hands-free speaker.

An apparatus as above, wherein the corresponding audio signal is configured to provide a masking signal or a masking noise corresponding to the downlink audio signal.

An apparatus as above, wherein the apparatus comprises a mobile phone.

In another exemplary embodiment, a method, comprising providing a sound reproduction system, providing at least one earpiece, and providing at least one hands-free speaker. Wherein the sound reproduction system is configured to provide a downlink audio signal to the at least one earpiece and a corresponding audio signal associated with the downlink audio signal to the at least one hands-free speaker.

A method as above, wherein the corresponding audio signal is configured to reproduce low frequencies for improved audio playback.

A method as above, wherein the corresponding audio signal is configured to provide a masking signal corresponding to the downlink audio signal.

A method as above, wherein the corresponding audio signal is configured to provide a masking signal or a masking noise corresponding to the downlink audio signal.

In another exemplary embodiment, a computer program product comprising a computer-readable medium bearing computer program code embodied therein for use with a computer, the computer program code comprising: code for providing a downlink audio signal to at least one earpiece, and code for providing a corresponding audio signal associated with the downlink audio signal to at least one hands-free speaker.

A computer program product as above, wherein the corresponding audio signal is configured to reproduce low frequencies for improved audio playback.

A computer program product as above, wherein the corresponding audio signal is configured to provide a masking signal corresponding to the downlink audio signal.

A computer program product as above, wherein the corresponding audio signal is configured to provide a masking signal or a masking noise corresponding to the downlink audio signal.

If desired, the different functions discussed herein may be performed in a different order and/or concurrently with each other. Furthermore, if desired, one or more of the above-described functions may be optional or may be combined.

Although various aspects of the invention are set out in the independent claims, other aspects of the invention comprise other combinations of features from the described embodiments and/or the dependent claims with the features of the independent claims, and not solely the combinations explicitly set out in the claims.

It is also noted herein that while the above describes example embodiments of the invention, these descriptions should not be viewed in a limiting sense.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. An apparatus, comprising:

a first earpiece proximate a top end of the apparatus;

a second earpiece proximate a bottom end of the apparatus;

at least one hands-free speaker; and a sound reproduction system comprising at least one of the first and second earpieces and the at least one hands-free speaker so as to provide a plurality of different handset usage orientations, wherein the sound reproduction system is configured to provide a downlink audio signal to at least one of the first and second earpieces based on at least one of the plurality of handset usage orientations of the apparatus and a corresponding audio signal associated with the downlink audio signal to the at least one hands-free speaker, wherein the at least one hands-free speaker comprises a back cavity configured to be acoustically coupled with an acoustic output of at least one of the first and second earpieces such that the downlink audio signal provided to the at least one of the first and second earpieces and the corresponding audio signal associated with the downlink audio signal provided to the at least one hands-free speaker are acoustically coupled when in use; and wherein a sensor is configured to detect which one of the first earpiece and the second earpiece is held against a user's ear.

2. The apparatus of claim 1 wherein the corresponding audio signal is configured to reproduce low frequencies for improved audio playback.

3. The apparatus of claim 2 wherein the corresponding audio signal comprises frequencies ranging about 600 Hz and below.

4. The apparatus of claim 1 wherein the corresponding audio signal is configured to provide a masking signal corresponding to the downlink audio signal.

5. The apparatus of claim 1 wherein the first earpiece comprises a first outlet and a second outlet, and wherein sound from the back cavity acoustically radiates from at least the second outlet of the first earpiece.

6. The apparatus of claim 5 wherein the second earpiece comprises a first outlet and a second outlet, and wherein the back cavity is connected to the second outlet of the second earpiece.

7. The apparatus of claim 6 wherein the first earpiece and the second earpiece acoustically radiate from a front face of the apparatus.

8. The apparatus of claim 6 wherein a portion of the back cavity is proximate the top end of the apparatus, and another different portion of the back cavity is proximate the bottom end of the apparatus.

9. The apparatus of claim 5 wherein the back cavity comprises an opening, wherein the opening forms a low pass filter.

10. The apparatus of claim 1 wherein the sound reproduction system is configured to provide the downlink audio signal to the first earpiece and a corresponding audio signal based on the downlink audio signal to the at least one hands-free speaker and the second earpiece.

11. The apparatus of claim 1 wherein the corresponding audio signal comprises at least a portion of the downlink audio signal when the sound reproduction system is configured for audio playback improvement, and wherein the corresponding audio signal comprises a masking signal associated with the downlink audio signal when the sound reproduction system is configured as a masking system.

12. The apparatus of claim 1 further comprising processor connected to the sound reproduction system, wherein the processor and the sound reproduction system are configured to cause the apparatus to perform at least the following:

analyze downlink speech emitted from at least one of the first and second earpieces;

generate a masking signal in response to the analyzed downlink speech; and emit the masking signal from the at least one hands-free speaker.

13. An apparatus as in claim 1 wherein the apparatus comprises a mobile phone.

14. The apparatus of claim 1 wherein the first and second earpieces are configured to both reproduce the same audio substantially all the time.

15. The apparatus of claim 14 wherein the at least one hands-free speaker is configured to reproduce a mix of both a low-pass filtered earpiece signal and a masking signal.

16. The apparatus of claim 1 wherein a sensor input is configured to determine which of the first and the second earpiece is an active earpiece, and wherein the other of the earpieces is configured to be silenced, or configure to reproducing a masking signal.

17. A method, comprising:

providing a sound reproduction system at an apparatus;

providing a first earpiece proximate a top end of the apparatus;

providing a second earpiece proximate a bottom end of the apparatus; and providing at least one hands-free speaker;

wherein the sound reproduction system comprises at least one of the first and second earpieces and the at least one hands-free speaker so as to provide a plurality of different handset usage orientations, wherein the sound reproduction system is configured to provide a downlink audio signal to at least one of the first and second earpieces based on at least one of the plurality of handset usage orientations of the apparatus and a corresponding audio signal associated with the downlink audio signal to the at least one hands-free speaker, and wherein the at least one hands-free speaker comprises a back cavity configured to be acoustically coupled with an acoustic output of at least one of the first and second earpieces such that the downlink audio signal provided to the at least one of the first and second earpieces and the corresponding audio signal associated with the downlink audio signal provided to the at least one hands-free speaker are acoustically coupled when in use; and wherein a sensor is configured to detect which one of the first earpiece and the second earpiece is held against a user's ear.

18. The method of claim 17 wherein the corresponding audio signal is configured to reproduce low frequencies for improved audio playback.

19. The method of claim 17 wherein the corresponding audio signal is configured to provide a masking signal corresponding to the downlink audio signal.

* * * * *